US010854976B2

(12) United States Patent
Daniel et al.

(10) Patent No.: US 10,854,976 B2
(45) Date of Patent: Dec. 1, 2020

(54) MAGNETIC DIPOLE ANTENNA WITH OMNIDIRECTIONAL E-PLANE PATTERN AND METHOD OF MAKING SAME

(71) Applicant: JEM ENGINEERING, Laurel, MD (US)

(72) Inventors: Chris Daniel, Westminster, MD (US); David Auckland, College Park, MD (US)

(73) Assignee: JEM ENGINEERING, Laurel, MD (US)

( * ) Notice: Subject to any disclaimer, the term of this patent is extended or adjusted under 35 U.S.C. 154(b) by 0 days.

(21) Appl. No.: 15/809,217

(22) Filed: Nov. 10, 2017

(65) Prior Publication Data

US 2019/0148842 A1 May 16, 2019

(51) Int. Cl.

| | |
|---|---|
| ***H01Q 21/24*** | (2006.01) |
| ***H01Q 7/06*** | (2006.01) |
| ***H01Q 9/26*** | (2006.01) |
| ***H01Q 1/36*** | (2006.01) |

(52) U.S. Cl.

CPC ..... *H01Q 7/06* (2013.01); *H01Q 1/364* (2013.01); *H01Q 9/265* (2013.01)

(58) Field of Classification Search

CPC ..... H01Q 7/06; H01Q 7/08; H01Q 1/364; H01Q 9/265

See application file for complete search history.

(56) References Cited

U.S. PATENT DOCUMENTS

| | | | | |
|---|---|---|---|---|
| 5,495,259 | A * | 2/1996 | Lyasko | H01Q 7/06 343/787 |
| 6,728,284 | B1 * | 4/2004 | Birx | H03K 3/57 359/345 |
| 8,558,752 | B2 | 10/2013 | Amadeo et al. | |
| 9,257,742 | B2 * | 2/2016 | Auckland | H01Q 1/364 |
| 10,020,581 | B2 * | 7/2018 | Diaz | H01Q 7/06 |
| 2011/0204147 | A1 | 8/2011 | Amadeo et al. | |
| 2011/0205140 | A1 | 8/2011 | Amadeo et al. | |
| 2015/0207232 | A1 * | 7/2015 | Dolgin | H01Q 21/245 455/114.2 |
| 2015/0236405 | A1 * | 8/2015 | Auckland | H01Q 1/364 343/787 |
| 2016/0365642 | A1 * | 12/2016 | Diaz | H01Q 7/06 |

* cited by examiner

*Primary Examiner* — Ab Salam Alkassim, Jr.

(57) ABSTRACT

An antenna includes an electrical excitation component and a core component. The electrical excitation component has and input and a conducting component. The conducting component can conduct current from the input. The core component has a magnetic film, having a substrate and a magnetic material layer, wound around a rectangular mounting plate. The core component can have a magnetic current loop induced therein. The electrical excitation component is arranged such that concentric magnetic fields associated with current conducted through the electrical excitation component are additionally associated with a magnetic current loop within the core component.

6 Claims, 28 Drawing Sheets

Prior Art

Prior Art

Prior Art

Prior Art

Prior Art

MAGNETIC DIPOLE ANTENNA WITH OMNIDIRECTIONAL E-PLANE PATTERN AND METHOD OF MAKING SAME

This invention was made with Government support under contract N6833513C0082 awarded by the Department of the Navy. The Government has certain rights to this invention.

BACKGROUND

The present invention generally relates to antennas.

There is a theoretical limit on the gain-bandwidth product that is achievable by an antenna. This limit applies whether the antenna is electric (i.e., charge-coupled) or magnetic (i.e., flux-coupled) in nature. Usually, increasing bandwidth (or decreasing Q) leads to a decrease in gain over the bandwidth of interest. There continue to be new results reporting ever closer encroachments on this limit.

Two types of prior art antennas will now be described with reference to FIGS. 1-16.

FIG. 1 illustrates an electrical dipole 108 and the electric and magnetic fields associated therewith.

As shown in the figure, a z-axis 102, an x-axis 106 and a y-axis 104 create a right-hand coordinate system. For purposes of discussion, in this example, electrical dipole 108 is disposed along z-axis 102. Electrical dipole 108 has an electrical field, represented by sample dotted lines 110, resulting from the disposition of positive charge +Q in the positive portion of z-axis 102 and negative charge −Q in the negative portion of z-axis 102. In accordance with the "right hand rule," electrical dipole 108 has a concentric omnidirectional magnetic field, represented by sample dashed line 112.

For purposes of discussion, consider the x-y plane where dashed line 112 intersects dotted lines 110. In this plane, constant magnetic field strengths form continuous circles and follow a right hand vector orientation rule. The electric fields for electric dipole 108 are spatially orthogonal to the magnetic fields and their lines of force begin and end on the ends of the electric dipole (charge coupled). The electric fields and magnetic fields may be represented as vector pairs, samples of which are shown as electric field vector 114 and magnetic field vector 116, and electric field vector 118 and magnetic field vector 120. The vector cross product of an electric field vector and magnetic field vector describe power flow that is radially outward from electric dipole 108.

In many applications, an electric dipole may be used as an antenna, wherein the length of the electric dipole antenna may be equal to one half of the wavelength of the first harmonic of an electromagnetic wave that may be transmitted/received. With regard to Earth-bound antenna applications, e.g., a prior art radio station antenna, an electric dipole may be cut in half, to form an electric monopole, wherein the Earth approximates an infinite ground plane or ideal ground. An electric monopole antenna would provide field characteristics equivalent to an electric dipole (for points along z-axis 102 >0) associated with FIG. 1. In particular, if the electric monopole were to correspond to the axis of the antenna, the power radiating from the antenna would radiate outward such that the length of the electric monopole antenna may equal one fourth of the wavelength of the first harmonic of an electromagnetic wave that may be transmitted/received. The field characteristics associated with an electric dipole (and the electric monopole) should be compared to a magnetic dipole, as described with reference to FIG. 2.

FIG. 2 illustrates a magnetic dipole 208 and the electric and magnetic fields associated therewith.

As shown in the figure, a z-axis 202, an x-axis 206 and a y-axis 204 create a right-hand coordinate system. For purposes of discussion, in this example, magnetic dipole 208 is disposed along z-axis 202. Magnetic dipole 208 has a magnetic field, represented by sample dashed lines 210, resulting from the disposition of the magnetic field lines running from the negative portion of z-axis 202 to the positive portion of z-axis 202. Magnetic dipole 208 generates lines of electric field, represented by sample dotted line 212, that encircle it in the x-y plane. Magnetic dipole 208 generates lines of magnetic field, represented by sample dashed lines 210, that begin and end on surfaces having a net magnetic flux density. Again, the electric fields and magnetic fields may be represented as vector pairs, samples of which are shown as electric field vector 214 and magnetic field vector 216, and electric field vector 218 and magnetic field vector 220. In accordance with the "right hand rule," magnetic dipole 208 has a concentric omnidirectional electric field, represented by sample dotted line 212.

The vector cross product of an electric field vector and magnetic field vector describe power flow that is radially outward from magnetic dipole 208. It should be noted that if the magnitude of M equals the magnitude of $\eta_0 J$, then $E(M_D)=-H(J)$ and $H(M_D)=E(J)$, where J is the electric current density in $A/m^2$, M is the magnetic current density in $V/m^2$, E is the electric field intensity in V/m and H is the magnetic field intensity in A/m. In other words, because the electric and magnetic field vector pairs have a specific relationship in an electric dipole antenna and a magnetic dipole antenna, the outward radiating power flow is equivalent An electric monopole (or dipole) and a magnetic dipole may be used to create an antenna. An example of an electric dipole antenna will now be described with reference to FIGS. 3-4.

FIG. 3 illustrates a prior art electric monopole antenna 302 using an electrical monopole to transmit a signal.

As shown in the figure, electric monopole antenna 302 is on a ground plane 304. A transmitter 306 is arranged to provide a current 308 to electric monopole antenna 302. Changes in current 308 generate transmission signals 310 from electric monopole antenna 302.

Consider the situation where current 308 is disposed within electric monopole antenna 302 such that charges resemble the electric dipole discussed above with reference to FIG. 1. In this manner, power will radiate outwardly from electric monopole antenna 302. As the current alternates, the radiating power will similarly alternate, providing transmission signals 310, which radiate outwardly. In this manner, electric monopole antenna 302 is an active device, transmitting a signal. Electric monopole antenna 302 may also perform as a passive device, receiving a signal.

FIG. 4 illustrates prior art electric monopole antenna 302 using an electrical monopole to receive a signal.

As shown in the figure, electric monopole antenna 302 is on a ground plane 304. A receiver 406 is arranged to receive a current 408 from electric monopole antenna 302. Received signals 410 generate changes in current 408, which are provided to receiver 406.

Signals 410 are electromagnetic waves. Electric monopole antenna 302 includes a conducting material. The interaction of signals 410 affect electrons within the conducting material of electric monopole antenna 302 to produce an overall charge therein. Consider the situation where such charges disposed within electric monopole antenna 302 resemble the electric dipole discussed above with reference to FIG. 1. As the electromagnetic fields change within signals 410, the magnitude and/or polarity of the charges within electric monopole antenna 302 similarly change. This change in the charge is current 408 (and similarly may be a change in current 408). Receiver 406 is able to receive current 408, and changes therein, to decode signals 410. In this manner, electric monopole antenna 302 is a passive device, receiving a signal. As mentioned above, a magnetic dipole may additionally be used as an antenna.

FIG. 5 illustrates a magnetic loop 508 and the electric and magnetic fields associated therewith.

As shown in the figure, a z-axis 502, an x-axis 506 and a y-axis 504 create a right-hand coordinate system. Magnetic loop 508 is disposed about z-axis 502 on the plane made by x-axis 506 and y-axis 504. Magnetic loop 508 has an associated electric field, represented by sample dotted lines 510, which have a concentric magnetic field, represented by sample dashed line 512. A resulting E, H vector pair is shown as lines 514 and 516 respectively, and another resulting E, H vector pair is shown as lines 518 and 520, respectively. The vector cross product of E and H describe power flow that is radially outward from magnetic loop 508.

The fields of magnetic loop 508 are identical to those of electric monopole 108 of FIG. 1, if $M_1$=J. Of particular interest is the case when magnetic loop 508 is placed on a perfect electric conductor (PEC) ground plane. A PEC is a theoretical abstraction. It is: 1) perfectly conducting, which means zero loss and zero skin depth; and 2) it extends to infinity. In this case, any voltage induced across the PEC will produce an infinite current, which will exactly cancel the applied voltage. Thus, the tangential voltage vector across any PEC shall always be zero. Tangential magnetic currents may flow against a PEC, and this is achieved with an antenna in accordance with the present invention. In that case, loop 508 becomes equivalent to an electric monopole excited perpendicular to the perfect electric ground plane.

A prior art magnetic loop antenna (MLA) behaves as a mathematical dual of a conventional electric monopole antenna.

FIG. 6 illustrates a side view of a prior art stacked magnetic tile core 600 for use in an antenna and a theoretical stacked magnetic film 602 for use in an antenna.

As shown in the figure, stacked magnetic tile core 600 includes a plurality of conductive magnetic material tiles, an example of which is indicated as tile 604. An exploded view of circular portion 606 of theoretical stacked magnetic film 602 is shown as circular portion 608. An exploded view of circular portion 610 is shown as circular portion 612.

Stacked magnetic tile core 600 provides magnetic field lines within each tile, in a direction along the length of the tiles. In this example, let each conductive magnetic material tile in stacked magnetic tile core 600 be 0.25 in. As the thickness of each tile increases, there is a corresponding increase in unwanted eddy currents because the material is conductive. These eddy currents produce heat within the conductive magnetic material tiles, thus reducing the overall Q factor of the stacked magnetic tile core 600. The Q factor is defined as the ratio of the power stored in the reactive electric and magnetic near fields to the power radiated by the antenna far fields per RF cycle, wherein a higher Q factor translates into a better magnetic core component for an antenna. Therefore, one way to increase the Q factor is to decrease the thickness of each conductive magnetic material tile. This may be accomplished by using films as opposed to tile, which leads to the theoretical stacked magnetic film 602.

Stacked film 602 includes a plurality of film layers, an example of which is labeled as 614. In this example, let each film layer be approximately 25 microns thick. Because each film in stacked film 602 is orders of magnitude less in thickness (i.e., 0.2 to 2 microns thick) as compared to each magnetic material tile in stacked magnetic tile core 600, stacked film 602 would have orders of magnitude less eddy currents. As such, stacked film 602 would theoretically have a much higher Q than stacked magnetic tile core 600.

FIG. 7 illustrates a side view of an example film 702 for use in a theoretical stacked magnetic film antenna. Film 702 includes a layer 704 of magnetic material disposed on a substrate 706. In this example, layer 704 and substrate 706 have an equal thickness. Substrate provides structural support for layer 704. Further, when film 702 is stacked upon another similar film, substrate 706 separates layer 704 from the adjacent magnetic material layer. This separation insulates the two magnetic material layers, which prevents adjacent conducting layers from touching and conducting between each other. As such, any generated eddy currents are trapped within a single layer of conductor. The separation is important, yet the actual thickness of substrate 706 does not need to equal layer 704.

FIG. 8 illustrates a side view of an example film 802 for use in a stacked film antenna. Film 802 includes a layer 804 of magnetic material disposed on a substrate 806. In this example, layer 804 is much thicker than substrate 806. Again, substrate provides separation of adjacent magnetic material layers, when the films are stacked. However, a bulk of the thickness of film 802 corresponds to the magnetic material such that a large amount of magnetic field lines may be generated. Minimization of substrate layer thickness achieves greater magnetization but must be traded with its ability to support sputtered films while under tension.

Layer 804 may be one of the group consisting of NiZn ferrite, $Co_2Z$ hexaferrite, CoFeSiMoB ferromagnetic metal alloy, CoZrNb ferromagnetic metal alloy, NiFe and its alloys, and combinations thereof.

A magnetic loop may be implemented via a magnetic core component. This will now be described with reference to FIGS. 9-11.

FIG. 9 illustrates an example prior art circular core component 902. Circular core component 902 has a circular shape with a hole 904 at its center.

FIG. 10 illustrates a cross sectional view of circular core component 902 of FIG. 9, as cut through line x-x.

As shown in FIG. 10, circular core component 902 has a cross-sectional portion 1002 and a cross-sectional portion 1004 about hole 904.

Circular core component 902 includes wound magnetic film, one layer of which is labeled as 1002. Each layer includes a substrate and a magnetic material layer, similar to that discussed above with reference to FIGS. 7-8. As a result of this structure, circular core component 902 is able to have a magnetic current loop induced therein. In FIG. 10, a magnetic loop is indicated in layer 1002 as dot 1006 and corresponding circle 1008 shown in cross-sectional portion 1004. In this example, dot 1006 represents the magnetic field loop entering the page, whereas circle 1008 represents the loop leaving the page, wherein the magnetic field loop would have a clockwise polarity as viewed with reference to FIG. 9.

FIG. 11 illustrates an example prior art transmission system 1100 using circular core component 902 of FIG. 9.

As shown in the figure, conventional transmission system 1100 includes circular core component 902, an electrical excitation component 1102 and a transmission component 1104. Transmission component is arranged to provide a current 1106 to electrical excitation component 1102. Current passing through electrical excitation component 1102 generates associated concentric magnetic fields, a sample of which is indicated by dotted line 1108. The concentric magnetic fields couple into circular core component 902 to induce a magnetic field loop within circular core component 902. Magnetic field loops within circular core component 902 may be exploited to transmit or receive electromagnetic signals as an antenna. Before discussing how circular core component 902 may be used to transmit/receive signals, a method of making a magnetic loop circular core component will be discussed.

FIG. 12 illustrates an example system 1200, at a time to, for forming a prior art circular core component of FIG. 9.

As shown in the figure, system 1200 includes a roll 1202 of magnetic film, a receiving blank 1204, a tension roller 1208, a tension roller 1210 and a controller 1212. Receiving blank 1204 includes a circular mandrel 1214, centrally located thereon.

Roll 1202 is a roll of film to be used to fabricate a magnetic loop circular core. Roll 1202 is rotatable, so as to unroll film 1206 therefrom.

Since the magnetic antennas will be fabricated by standing the films on edge, the width w of the cut film is chosen to be equal to the vertical antenna height as desired.

Tension roller 1208 can rotate and is able to move up and down in a direction indicated by double arrow 1222. Film 1206 is able to pass over rolling tension roller 1208 at location 1216. Tension roller 1210 can rotate and is able to move up and down in a direction indicated by double arrow 1224. Film 1206 is able to pass over rolling tension roller 1210 at location 1218. As such, the tension of magnetic film 1206 may be managed by moving either or both of tension roller 1208 and tension roller 1210 in a respective direction. Tension roller 1208 and tension roller 1210 are non-limiting examples of known tension management devices. Any known device for maintaining a predetermined tension may be used so as to prevent film 1206 from buckling or curling as it winds around circular mandrel 1214.

Receiving blank 1204 is rotatable. Circular mandrel 1214 is able to have an end of film 1206 anchored thereto at location 1220, by any known anchoring method or system, non-limiting examples of which include an adhesive, magnetically, a slit for which film 1206 may be inserted, or a grabbing mechanism.

Film 1206 is unrolled from roll 1202, is fed by tension roller 1208, is fed by tension roller 1210 and is anchored onto circular mandrel 1214.

Controller 1212 is able to: control roll 1202 via communication channel 1226; control receiving blank 1204 via communication channel 1228; control tension roller 1208 via communication channel 1230 and control tension roller 1210 via communication channel 1232. Each of communication channels 1226, 1228, 1230 and 1232 may be any known type of wired or wireless communication channel.

Controller 1212 is able to control the rate at which roller 1202 unrolls the film and is able to control the rate at which receiving blank 1204 winds the film. Controller 1212 is additionally able to control the amount of movement of tension roller 1208 along the direction of double arrow 1222 and to control the amount of movement of tension roller 1210 along the direction of double arrow 1224.

FIG. 13 illustrates example system 1200, at a time $t_1$.

As film 1206 unrolls from roll 1202, it eventually winds around circular mandrel 1214 to form a magnetic loop circular core, an incomplete portion of which is indicated in FIG. 13 as circular core portion 1302. Controller 1212 positions tension rollers 1208 and 1210 so as to ensure film 1206 does not crinkle, fold or bunch as it is wound about circular mandrel 1214. As such, this method of creating layers of film avoids the problems associated with the stacked film core discussed above with reference to FIG. 6. Further, inter-layer adhesives are not needed to maintain circular core component by winding around circular mandrel 1214. This is a beneficial aspect, as inter-layer adhesives are not desirable because they decrease the overall Q of the circular core component. Once the circular core component is complete, e.g. the number of windings reaches a total required thickness in the circular core component, any known method of mechanically holding a film to its circular mandrel form may be used, non-limiting examples of which include locally arranged electromagnets. At that point, a compression form may be used to hold the wound circular core component on circular mandrel 1214.

The magnetic circular core component winding process described above with reference to FIGS. 12-13 may produce a less than optimal magnetic circular core component. In particular, tension rollers 1208 and 1210 contacting film 1206 may damage film 1206. Further any particulates that accumulate on tension rollers 1208 and 1210 may be transferred to film 1206, which will decrease the homogeneity of the final magnetic circular core component.

The gain of a MLA may be maximized by utilizing anisotropic magnetic materials. Magnetic anisotropy is the directional dependence of a material's magnetic properties. In the absence of an applied magnetic field, a magnetically isotropic material has no preferential direction for its magnetic moment, while a magnetically anisotropic material will align its moment with one of the easy axes. An easy axis is an energetically favorable direction of spontaneous magnetization that is determined by the known sources of magnetic anisotropy. The two opposite directions along an easy axis are usually equivalent, and the actual direction of magnetization can be along either of them.

A magnetic material with triaxial anisotropy still has a single easy axis, but it also has a hard axis (direction of maximum energy) and an intermediate axis (direction associated with a saddle point in the energy). Film 1206 exploits the hard axis of a triaxially anisotropic material. In particular, anisotropic magnetic film of roll 1202 has an easy axis along the width of film 1206 and a hard axis along the length of film 1206.

The first step in using magnetic film materials is to identify their axes of anisotropy. In this example, a magnetic film is sputtered so as to exhibit a hard axis that is parallel to the direction of roll processing. By taking advantage of the hard axes, magnetic loop circular core component 902 is able to couple a much larger amount of the magnetic field lines from an electrical excitation component.

Once the circular core component is constructed, electrical excitation components, e.g., flux coupling loops, may then be added after the winding process. These electrical excitation components may be connected to a power distribution network which can achieve any number of desired modes with the antenna.

FIG. 14 illustrates an example prior art circular MLA 1400.

As shown in the figure, antenna 1400 includes a back support 1402, a circular core component 1404, a front support 1406, a circular mandrel 1408, an electrical excitation component 1410, an electrical excitation component 1412, and electrical excitation component 1414 and an electrical excitation component 1416.

In this example, back support 1402 corresponds to receiving blank 1204 of FIG. 12 and circular mandrel 1408 corresponds to circular mandrel 1214 of FIG. 12. Front support 1406 encloses circular core component 1404. Although electrical excitation components 1410, 1412, 1414 and 1416 are used in this example, any number of electrical excitation components may be used.

Each of electrical excitation components 1410, 1412, 1414 and 1416 has an input, an output and a conducting component. For example, electrical excitation component 1412 has an input 1418, an output 1420 and a conducting component 1422. Conducting component 1422 is disposed between the input and the output and is able to conduct current from the input to the output. In this manner, electrical excitation component 1412 is able to induce a magnetic loop within circular core component 1404 in a manner similar to that discussed above with reference to FIG. 11.

FIG. 15 illustrates a prior art circular MLA 1502 using a magnetic loop to transmit a signal.

As shown in the figure, circular MLA 1502 is disposed to receive a current 1504 from a transmitter 1506. Changes in current 1504 generate transmission signals 1508 from 1502.

Consider the situation where current 1504 is fed to circular MLA 1502 such that generated magnetic loop within the circular core component resembles the magnetic loop discussed above with reference to FIG. 5. In this manner, power will radiate outwardly from circular MLA 1502. As the current alternates, the radiating power will similarly alternate, providing transmission signals 1508, which radiate outwardly. In this manner, circular MLA 1502 is an active device, transmitting a signal. Circular MLA 1502 may also perform as a passive device, receiving a signal.

FIG. 16 illustrates circular MLA 1502 using a magnetic loop to receive a signal in accordance with aspects of the present invention.

As shown in the figure, circular MLA 1502 is arranged to receive signals 1602. Changes in signals 1602 generate changes in a current 1604, which is provided to a receiver 1606.

Signals 1602 are electromagnetic waves. The interaction of signals 1602 induces magnetic fields within the magnetic material of the magnetic circular core of circular MLA 1502. The magnetic fields within the magnetic circular core of circular MLA 1502 induce a current in an electrical excitation component of circular MLA 1502. As the electromagnetic fields change within signals 1602, the magnitude and/or polarity of the magnetic fields within the magnetic circular core of circular MLA 1502 similarly change. This change in the magnetic fields corresponds to current 1604. Receiver 1606 is able to receive current 1604, and changes therein, to decode signals 1602. In this manner, circular MLA 1502 is a passive device, receiving a signal.

FIG. 17 illustrates the electric field vectors circular MLA 1502 when transmitting at a time $t_1$ with a frequency $f_1$ that is much lower than the resonant frequency of circular MLA 1502.

As shown in the figure, the electric field vectors make a path through circular MLA 1502 within a xyz coordinate system, a sample representation of which is indicated as dotted lines 1702 and 1704. At time $t_1$, the electric field vectors on the outer surface are pointing in the positive z-direction as shown by arrows 1706, 1708, 1710 and 1712. Further, the electric field vectors on the inner surface are pointing in the negative z-direction as shown by arrows 1714, 1716, 1718 and 1720. The electric fields radiate generally equally within the y-plane as indicated by dashed circles 1722 and 1724.

As the magnetic field oscillates in circular MLA 1502 the radiating electric (and corresponding magnetic fields—not shown) will alternate in direction. However, for purposes of discussion, FIG. 17 illustrates a "snap shot" of the fields at a single time.

As further noted in the figure, the field radiation has a null along the z-axis as shown in areas 1726 and 1728. In other words, no signal is transmitted in a direction normal to the flat surface of circular MLA 1502. These nulls are a result of electrical excitation components 1410, 1412, 1414 and 1416 (as shown in FIG. 14) being spaced radially equidistant from one another and being driven in phase. As such, any circumferential magnetic fields generated by electrical excitation component 1410 will be effectively cancelled by an equal and opposite circumferential magnetic field generated by electrical excitation component 1414 along the z-axis. Similarly, any circumferential magnetic fields generated by electrical excitation component 1412 will be effectively cancelled by an equal and opposite circumferential magnetic field generated by electrical excitation component 1416 along the z-axis.

The fields radiated by MLA 1502 would appear to a receiving antenna to be the same as those produced by an electric dipole that is disposed at the z-axis, wherein the H-field is revolving around the z-axis. This duality is discussed above with reference to FIGS. 1-2. In other words, with MLA 1502, just as with the conventional electric dipole antenna, the E-field is omnidirectional with a vertical polarization. This will be described with greater detail to FIG. 18.

FIG. 18 illustrates an electromagnetic wave from a conventional transmitting electric dipole antenna 1802 to a conventional receiving electric dipole antenna 1804.

As shown in the figure, conventional transmitting electric dipole antenna 1802 is disposed so as to be rotated 90° from conventional receiving electric dipole antenna 1804. This arrangement between the two antennas may occur for example in a situation where a vehicle may not be able to have an antenna disposed in the z direction in order to meet prescribed aerodynamic design parameters. In such a situation, a transmission from conventional transmitting electric dipole antenna 1802 to conventional receiving electric dipole antenna 1804 includes a sinusoidal electric field 1806 and a sinusoidal magnetic field 1808, wherein electric field 1806 is perpendicular to magnetic field 1808. In particular, electric field 1806 oscillates in the yz-plane, perpendicular to the disposition (length) of receiving electric dipole antenna 1804. On the contrary, magnetic field 1808 oscillates in the xy-plane, along the disposition (length) of receiving electric dipole antenna 1804. In this manner, it is magnetic field 1808 that most greatly affects the operation of receiving electric dipole antenna 1804, not electric field 1806.

As MLA 1502 of FIG. 15 performs in a manner similar to a conventional electric dipole, for example as discussed above with reference to FIGS. 1-2, MLA 1502 would transmit is a similar manner as conventional transmitting electric dipole antenna 1802.

Typically, a receiver antenna is an electric antenna. As such, a typical antenna responds to oscillations in the electric field of an EM wave. Therefore, an omnidirectional e-field with a horizontal polarization (the yz-plane) is highly sought. Unfortunately, an omnidirectional e-field with a horizontal polarization (the yz-plane) cannot be obtained by simply repositioning a conventional electric dipole transmitting antenna. This will be described in more detail with reference to FIG. 19.

FIG. 19 illustrates electric field lines from conventional transmitting electric dipole antenna 1802 disposed perpendicularly to conventional receiving electric dipole antenna 1804.

As shown in the figure, conventional transmitting electric dipole antenna 1802 is positioned along the y-axis, in an attempt to result in omnidirectional e-field with a horizontal polarization (the yz-plane). However, as discussed with reference to FIG. 17 above, such a positioning of transmitting electric dipole antenna 1802 provides electric field lines, a sample of which are indicated as dotted lines 1902 and 1904. More importantly, a null 1906 is generated along the y-axis. As such, receiving electric dipole antenna 1804 will receive little, if no, electric fields from transmitting electric dipole antenna 1802 if positioned along the y-axis.

As MLA 1502 of FIG. 15 performs in a manner similar to a conventional electric dipole, for example as discussed above with reference to FIGS. 1-2, MLA 1502 would transmit is a similar manner as conventional transmitting electric dipole antenna 1802 if positioned to transmit along the y-axis.

There are conventional systems that approximate an omnidirectional e-field with a horizontal polarization (the yz-plane) using a plurality of conventional transmitting electric dipole antennas. This will be described in greater detail with reference to FIG. 20.

FIG. 20 illustrates electric field lines from two conventional transmitting electric dipole antennas 2002 and 2004 disposed at an angle relative to conventional receiving electric dipole antenna 1804.

As shown in the figure, conventional transmitting electric dipole antenna 2002 is disposed at an angle θ relative to they-axis, whereas conventional transmitting electric dipole antenna 2004 is disposed at an angle −θ relative to the y-axis. Conventional transmitting electric dipole antenna 2002 provides electric field lines, a sample of which are indicated as dotted lines 2006 and 2008. Further, a null 2010 is generated at angle θ relative to they-axis. Similarly, conventional transmitting electric dipole antenna 2004 provides electric field lines, a sample of which are indicated as dotted lines 2012 and 2014. Further, a null 2018 is generated at angle −θ relative to the y-axis.

By positioning conventional transmitting electric dipole antennas 2002 and 2004 at an angle relative to the y-axis, a null in the y-axis toward conventional receiving electric dipole antenna 1804 is avoided. The superposition of the electric fields from each of conventional transmitting electric dipole antennas 2002 and 2004 are received at conventional receiving electric dipole antenna 1804. This approximation of an omnidirectional e-field with a horizontal polarization (the yz-plane) using two offset conventional electric dipole antennas fails to accurately represent a true omnidirectional e-field with a horizontal polarization (the yz-plane). In fact, such implementations—for example VOR applications as discussed above—may have a 5-10 dB E-field attenuation in along the y-axis.

As MLA 1502 of FIG. 15 performs in a manner similar to a conventional electric dipole, for example as discussed above with reference to FIGS. 1-2, an offset arrangement of two MLAs would transmit is a similar manner as conventional transmitting electric dipole antennas 2002 and 2004 if positioned to transmit along they-axis.

Returning to FIG. 17, the broadside beam pattern of circular MLA 1502 along the xy-plane is prominent and uniform. However, it has been determined through experimentation that with high order transmission modes, the broadside beam pattern along the xy-plane develops a null. In particular, a null develops when two fields are canceling in a manner similar to that discussed above with reference to the nulls of electrical excitation components 1410, 1412, 1414 and 1416 discussed above. However, in the case of MLA 1502 along the xy-plane, there is a difference in the distance from the observer. When this difference is such that the time of arrival results in opposite phasing between two signals, then the two signals will destructively interfere with one another, thus resulting in a null. This will be described with reference to FIG. 21.

FIG. 21 illustrates the electric field vectors circular MLA 1502 when transmitting at a time $t_2$ with a frequency $f_h$ that is at or above the resonant frequency of circular MLA 1502.

As shown in the FIG. 21, the electric field vectors make a path through circular MLA 1502 within a xyz coordinate system, a sample representation of which is indicated as dotted lines 2102, 2104, 2106 and 2108. At time $t_2$, the electric field vectors on the outer surface are pointing in the positive z-direction as shown by arrows 2110, 2112, 2114 and 2116. Further, the electric field vectors on the inner surface are pointing in the negative z-direction as shown by arrows 2118 and 2120. The electric fields radiate generally equally within the xy-plane as indicated by dashed circles 2122 and 2124.

As the magnetic field oscillates in circular MLA 1502 the radiating electric (and corresponding magnetic fields—not shown) will alternate in direction. However, for purposes of discussion, FIG. 21 illustrates a "snap shot" of the fields at a single time.

As further noted in the figure, the field radiation has a null along the z-axis as shown in areas 2126 and 2128, just as in the situation discussed above with reference to FIG. 17.

However, unlike the situation wherein circular MLA 1502 is driven at lower order modes, as discussed above with reference to FIG. 17, when circular MLA 1502 is driven at higher order modes, as discussed above with reference to FIG. 21, another null is formed in the xy-plane at the circular MLA as shown in area 2130.

Wire monopoles increase drag for moving vehicles. This reduces ultimate speed, increases fuel consumption, and can add to environmental risks (damage, icing effects). Wire monopoles can additionally be prone to damage. Further, vertical conductors, such as wire monopoles are easily picked up by radar, such that many situations favor an antenna that has a reduced visual profile What is needed is an antenna that provides a transmission function similar to a conventional electric monopole antenna, but without the large height associated with the conventional electric monopole antenna. What is additionally needed is an MLA that is able to operate at a resonant frequency without generating a null in the xy-plane.

BRIEF SUMMARY

The present invention, which may be called a "magnetic dipole antenna," provides an antenna that transmits and receives radio frequencies with field patterns similar to those of a conventional electric dipole antenna. The magnetic dipole produces an electric field pattern identical to the conventional antenna's magnetic field pattern. The magnetic dipole's magnetic field pattern is identical to the conventional dipole's electric field pattern. Thus, for example, the magnetic dipole oriented along the z axis will have an omnidirectional electric field pattern in the x-y plane whereas an electric dipole oriented along the z axis will have an omnidirectional magnetic field pattern in the x-y plane. Also, as the antenna is operated at higher frequencies, where its length is one wavelength or more, the electric field in the x-y plane does not exhibit a null as is the case with an electric dipole of the same electrical length.

An aspect of the present invention is drawn to an antenna including an electrical excitation component and a core component. The electrical excitation component has an input and a conducting component. The conducting component can conduct current from the input. The core component has a magnetic film, having a substrate and a magnetic material layer, wound around a rectangular flat mandrel. The core component can have a magnetic current induced therein. The electrical excitation component is arranged such that concentric magnetic fields associated with current conducted through the electrical excitation component are additionally associated with a magnetic current within the core component.

Additional advantages and novel features of the invention are set forth in part in the description which follows, and in part will become apparent to those skilled in the art upon examination of the following or may be learned by practice of the invention. The advantages of the invention may be realized and attained by means of the instrumentalities and combinations particularly pointed out in the appended claims.

BRIEF SUMMARY OF THE DRAWINGS

The accompanying drawings, which are incorporated in and form a part of the specification, illustrate an exemplary embodiment of the present invention and, together with the description, serve to explain the principles of the invention. In the drawings.

DETAILED DESCRIPTION

A MLA in accordance with aspects of the present invention includes a magnetic core component that includes a rectangular mounting plate as opposed to a circular mandrel as discussed above with respect to the prior art circular MLA. A magnetic film is would around the rectangular mounting plate to form an elongated core component as opposed to the circular core component discussed above with respect to the prior art circular MLA. The elongated core component is used in the elongated MLA of the present invention.

The elongated MLA of the present invention is able to operate at a resonant frequency without generating a null in the xy-plane. Further, an elongated MLA in accordance with aspects of the present invention provides a true omnidirectional electric field with a horizontal polarization.

Aspects of the present invention will now be described in greater detail with reference to FIGS. 22A-37.

Figure 22B:
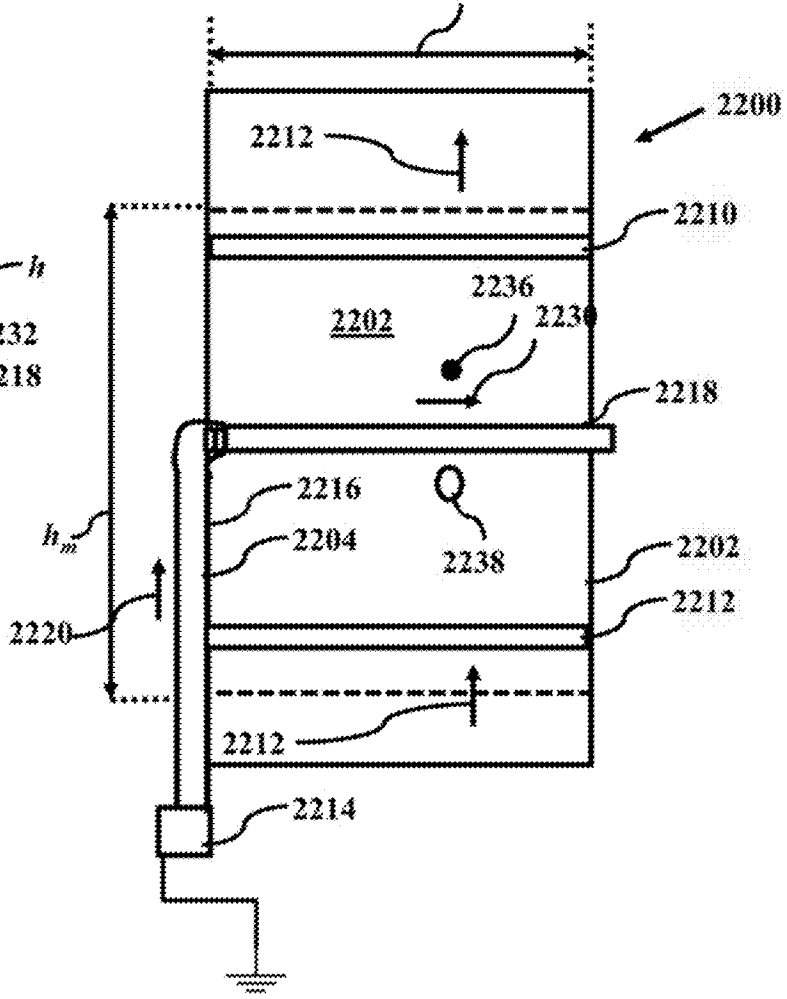
FIG. 22B illustrates a front view of the elongated MLA of FIG. 22A.
Figure 22A:
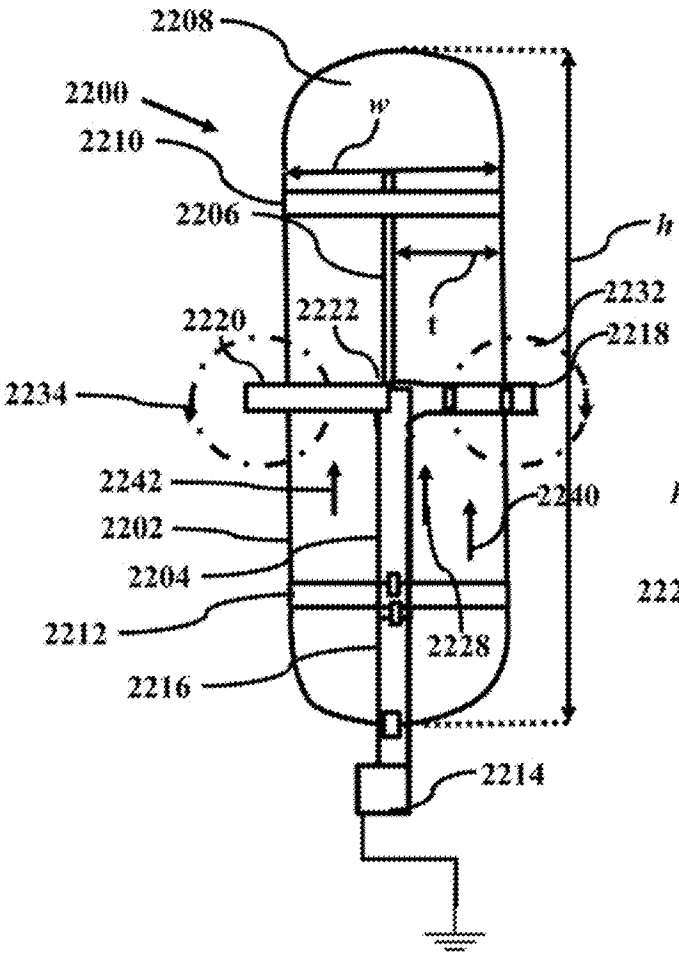
FIG. 22A illustrates a side view of an elongated MLA in accordance with aspects of the present invention.
Figure 22C:
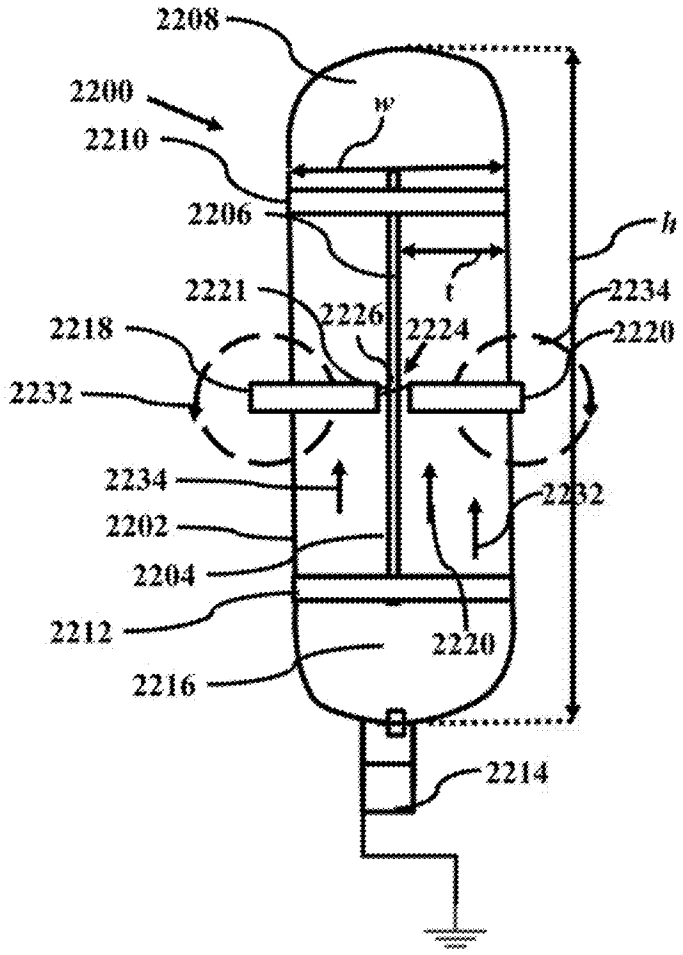
FIG. 22C illustrates the opposite side view of the elongated MLA of FIG. 22A.

FIG. 22A illustrates a side view of an elongated MLA 2200 in accordance with aspects of the present invention. FIG. 22B illustrates a front view of elongated MLA 2200 of FIG. 22A. FIG. 22C illustrates a side view, parallel to the side view of FIG. 22A of elongated MLA 2200 in accordance with aspects of the present invention.

As shown in the figures, elongated MLA 2200 includes an elongated core component 2202 and an electrical excitation component 2204. Elongated core component 2202 includes a mounting plate 2206, a magnetic film winding 2208, a binding strip 2210 and a binding strip 2212. Electrical excitation component 2204 includes a feed component 2214, a parallel portion 2216, a wrapped portion 2218 and a wrapped portion 2220.

Elongated core component 2202 has a height, h, a length, l, and a width, w. Further, magnetic film winding 2208 has a thickness, t, around mounting plate 2206.

Mounting plate 2206 may be any known non-conducting material. In this example embodiment, mounting plate 2206 is a rectangular parallel piped having a thickness Δ, a length l and a height $h_m$. Mounting plate 2206 provides an initial shape for a structural support for magnetic film winding 2208.

Figure 7:
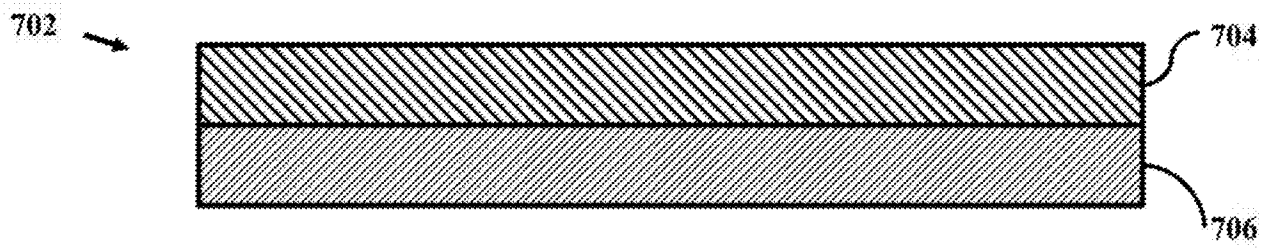
FIG. 7 illustrates a side view of an example film for use in a theoretical stacked magnetic film antenna.
Figure 8:
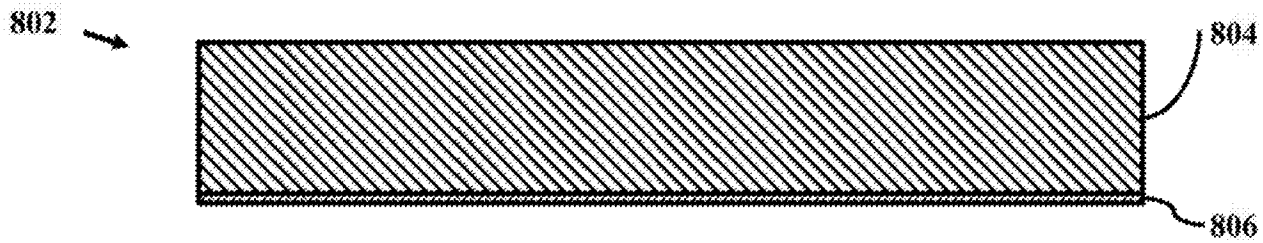
FIG. 8 Prior Art
FIG. 8 illustrates a side view of an example film for use in a stacked film antenna.
Figure 10:
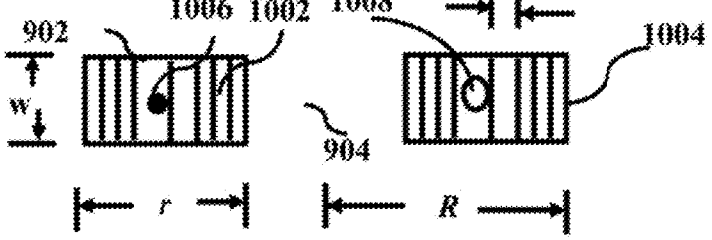
FIG. 10 illustrates a cross sectional view of the circular core component of FIG. 9, as cut through line x-x.
Figure 9:
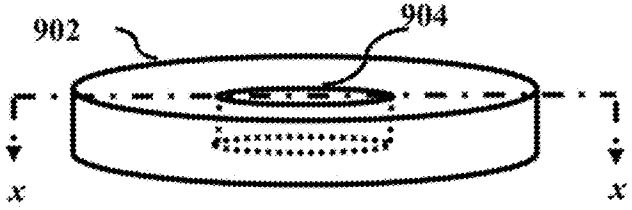
Prior Art FIG. 9
FIG. 9 illustrates an example prior art circular core component.
Figure 11:
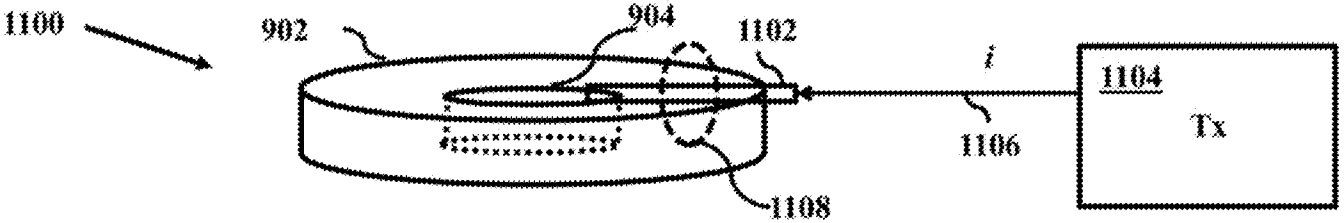
Prior Art FIG. 11
FIG. 11 illustrates an example prior art transmission system using a circular MLA.
Figure 12:
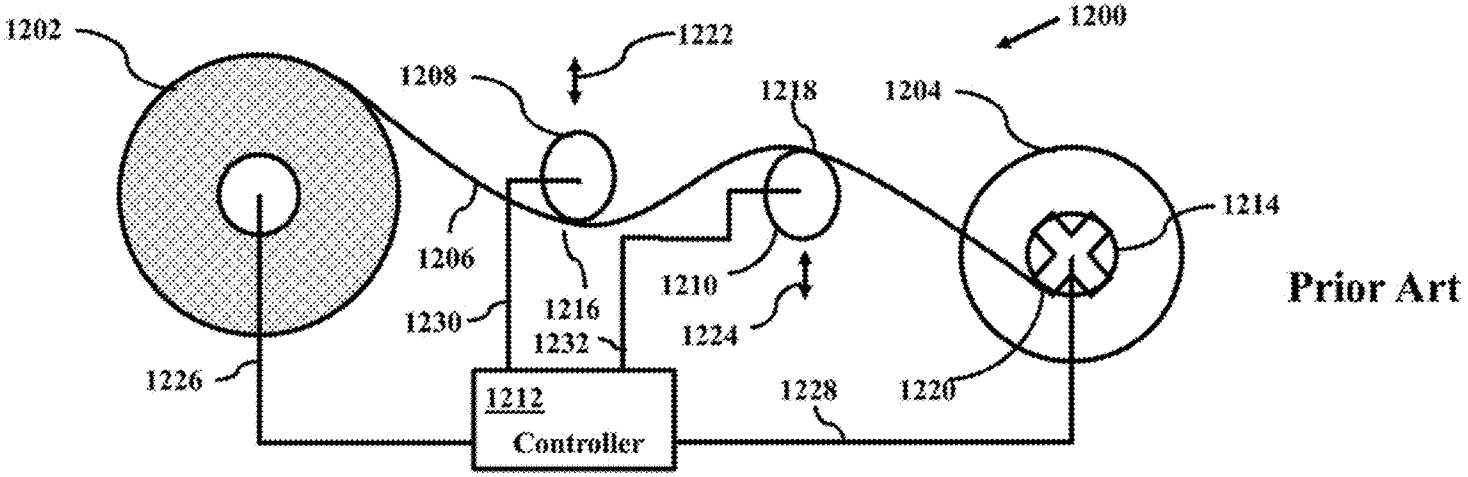
FIG. 12 illustrates an example system, at time to, for forming a prior art circular core component of FIG. 9.
Figure 13:
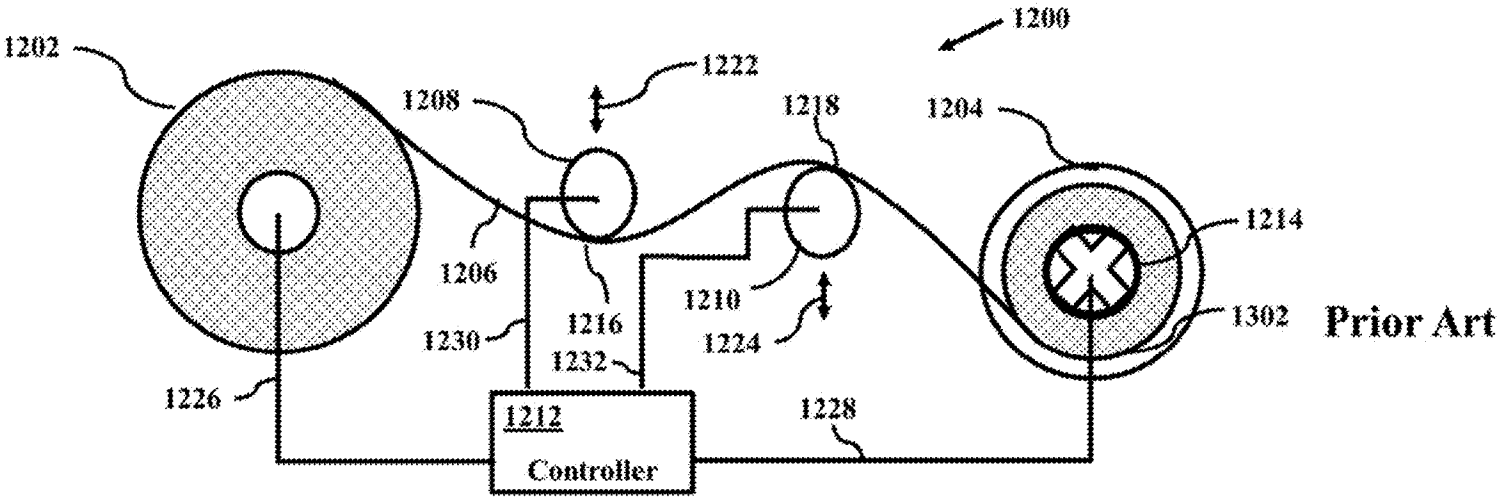
FIG. 13 illustrates the example system of FIG. 12, at a time $t_1$.
Figure 14:
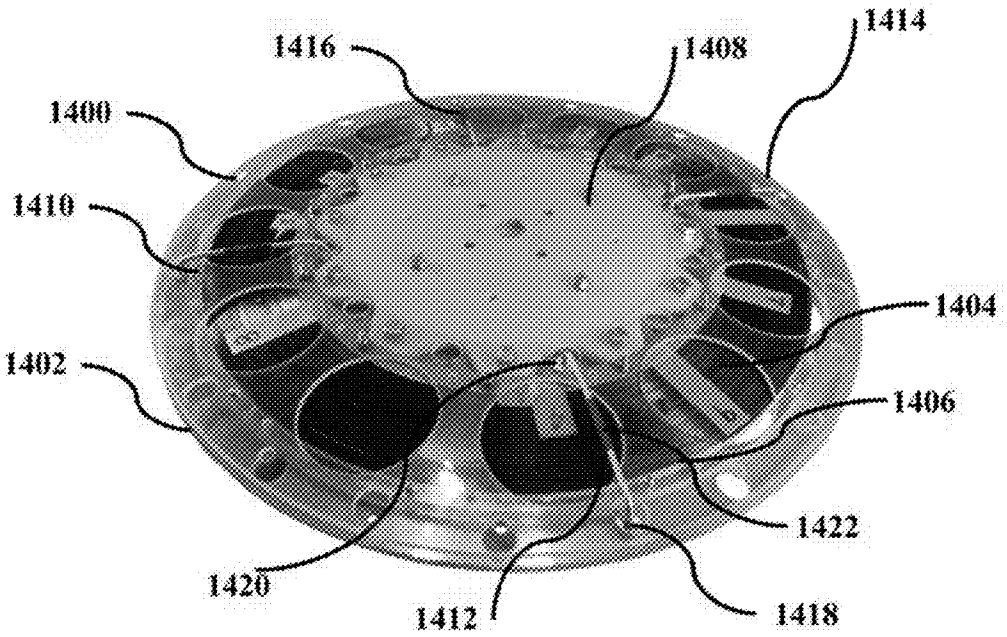
FIG. 14 illustrates an example prior art circular MLA.
Figure 16:
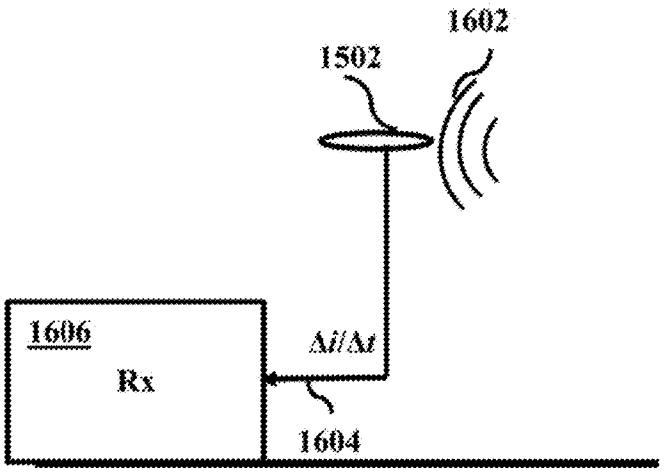
FIG. 16 illustrates the prior art circular MLA of FIG. 15, using a magnetic loop to receive a signal.
Figure 15:
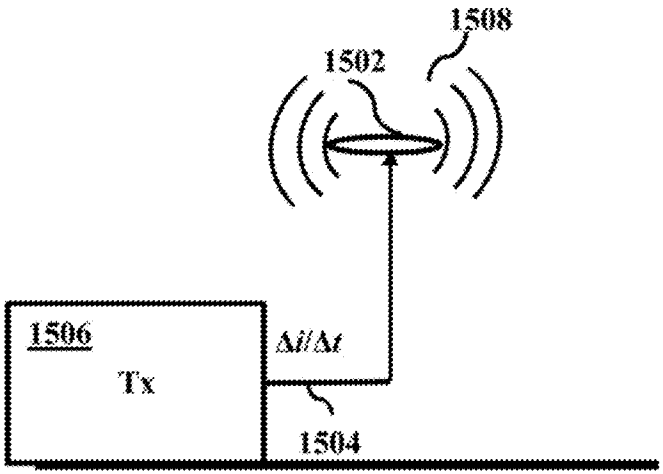
Prior Art FIG. 15
FIG. 15 illustrates a prior art circular MLA using a magnetic loop to transmit a signal.

Magnetic film winding 2208 is a winding for magnetic film similar to that discussed above with reference to FIGS. 7-8. As a result of this structure, elongated core component 2202 is able to have a magnetic current induced therein.

Binding strip 2210 and binding strip 2212 may be any known non-conducting material. Binding strip 2210 and binding strip 2212 wrap around elongated core component 2202 to retain the shape of elongated core component 2202. It should be noted that any number of binding strips may be used, whereas two are illustrated in this non-limiting example for purposes of discussion.

In an example embodiment, parallel portion 2216, wrapped portion 2218 and wrapped portion 2220 are a coaxial line, having an inner conducting line and an outer circumferential conducting jacket. As shown in FIG. 22A, the outer conducting jacket of wrapped portion 2218 is electrically connected to the outer conducting jacket of wrapped portion 2220 at point 2222. As shown in FIG. 22C, wrapped portion 2218 is spaced from wrapped portion 2220 by a space 2224. As further sown in FIG. 22C, the inner conducting line of wrapped portion 2218 is electrically connected to the outer conducing jacket of wrapped portion 2220 by a conducting line 2226.

In operation, a driving current is provided to feed component 2214, which travels through parallel portion 2216, wrapped portion 2218 and wrapped portion 2220. The driving current is an oscillating signal.

For purposes of discussion, as shown in FIG. 22A, consider a moment in time when the driving current is traveling through parallel portion 2216, in a direction indicated by arrow 2228, and as shown in FIG. 22B, through wrapped portion 2218, in a direction indicated by arrow 2230.

Current passing through wrapped portion 2218 and wrapped portion 2220 generates associated concentric magnetic fields, a sample of which is indicated in FIG. 22A by dashed lines 2232 and 2234.

Returning to FIG. 22C, It should be noted that as a result of the inner conducting line of wrapped portion 2218 being electrically connected to the outer conducting jacket of wrapped portion 2220 by a conducting line 2226 at space 2224, the magnetic field associated with dashed line 2232 has the same polarity as the magnetic field associate with dashed line 2234. As shown in FIG. 22B, the magnetic field associated with dotted line 2232 is traveling in a direction out of the figure as indicated by dot 2236 and is returning into the figure as indicated by circle 2238. The induced magnetic field lines with be described in greater detail with reference to FIG. 23.

Figure 23:
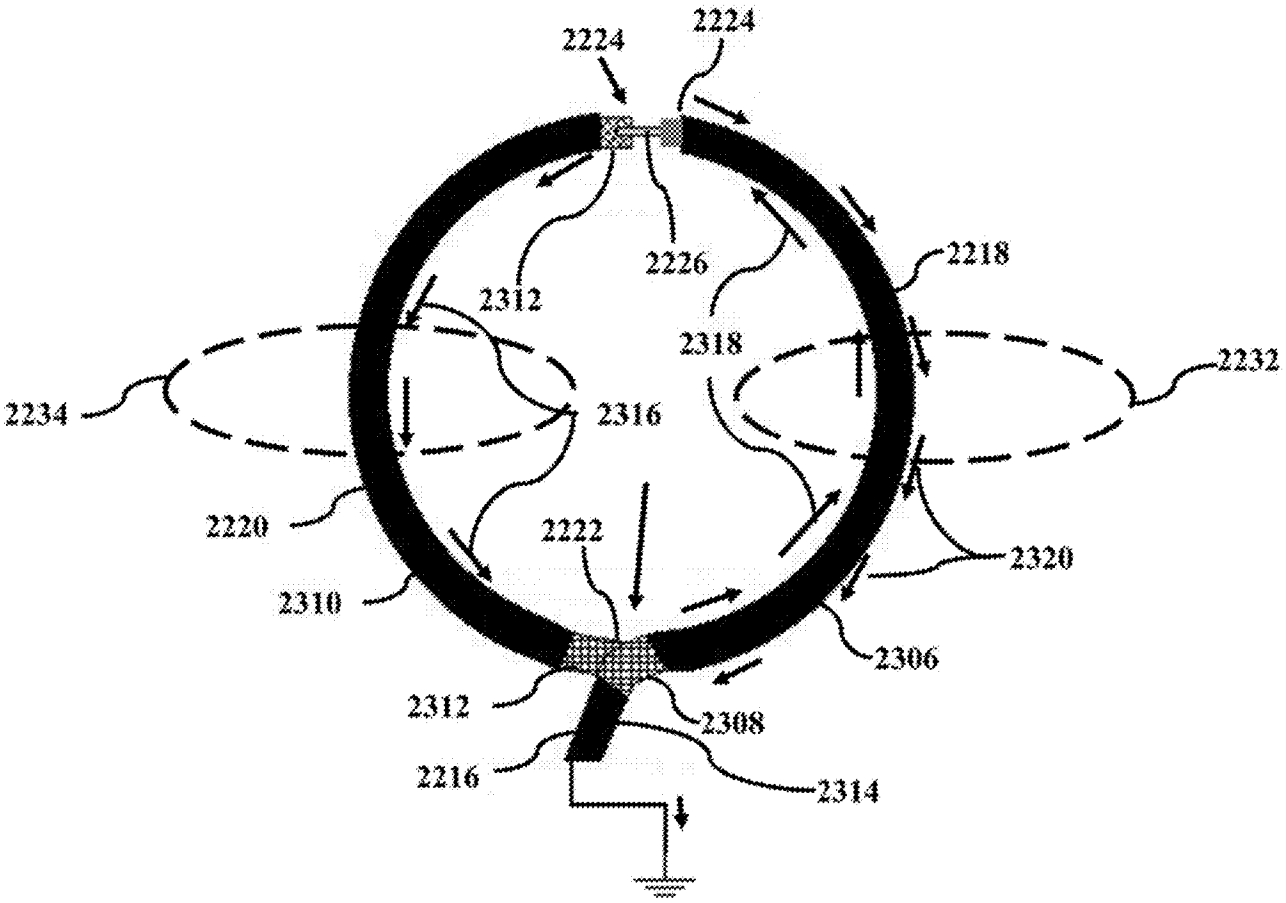
FIG. 23 illustrates a front view of the elongated MLA of FIG. 22A.

FIG. 23 illustrates a more detailed view of electrical excitation component 2204.

As shown in the figure, wrapped portion 2218 includes an insulating sheathing 2306 wrapped around an outer conducting jacket 2308, whereas wrapped portion 2220 includes an insulating sheathing 2310 wrapped around an outer conducing jacket 2312.

Wrapped portion 2218 is a continuation of parallel portion 2216, wherein a portion of the outer sheathing is removed to uncover a portion of outer conducting jacket 2308 at point 2222. Further, outer conducting jacket 2312 of wrapped portion 2310 is electrically connected, e.g., via soldering, to outer conducting jacket 2308 at point 2222.

The inner conducting line of wrapped portion 2218 is electrically connected to an outer side of outer conducting jacket 2312 of wrapped portion 2220 via conducting line 2226.

The outer side of the outer conducting jacket of parallel portion 2216 (not shown) is electrically connected to the outer side of outer conducting jacket 2312 of wrapped portion 2220 and is additionally connected to ground.

For purposes of discussion, consider the situation where current is provided to excitation component 2204. More specifically, current is provided to the inner conducting line of parallel portion 2216 and conducts through wrapped portion 2218 as indicated by arrows 2314. The current then conducts through conducting line 2226 to the outer side of the outer conducting jacket of parallel portion 2220 as indicated by arrows 2316. The current then continues through point 2222 and conducts through the outer side of the outer conducting jacket of parallel portion 2218 as indicated by arrows 2318 toward space 2224. At that point, the current travels to the inner side of the outer conducting jacket of parallel portion 2218 as indicated by arrows 2320 to ground.

The current flowing on the outer side of the outer conducting jacket of parallel portion 2220 creates circular magnetic fields, a sample of which is indicated by dotted line 2234. Similarly, the current flowing on the outer side of the outer conducting jacket of parallel portion 2218 creates circular magnetic fields, a sample of which is indicated by dotted line 2232.

Returning to FIG. 22A, the concentric magnetic fields couple into elongated core component 2202 to induce a magnetic field loop within elongated core component 2202. For example, the magnetic field associated with dashed line 2232 induces a magnetic field in the direction of arrow 2240 within elongated core component 2202. Similarly, the magnetic field associated with dashed line 2234 induces a magnetic field in the direction of arrow 2242 within elongated core component 2202.

Magnetic field loops within elongated core component 2202 may be exploited to transmit or receive electromagnetic signals as an antenna. In a manner similar to circular core component 902 discussed above with reference to FIGS. 9-16.

Figure 6:
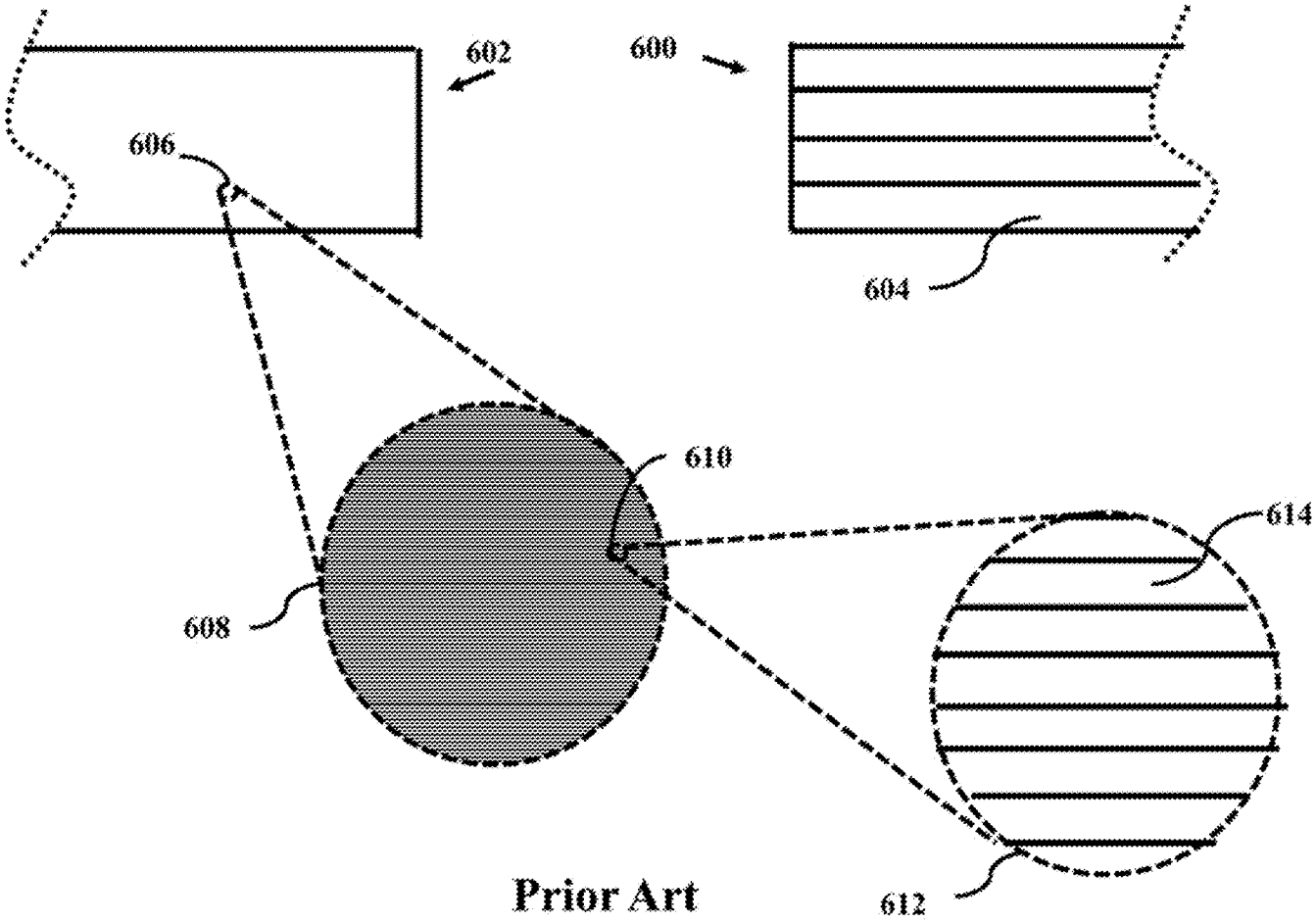
FIG. 6 illustrates a side view of a prior art stacked magnetic tile core for use in an antenna and a theoretical stacked magnetic film for use in an antenna.

The amount of magnetic field lines induced within magnetic film winding 2208 is proportional to the volume of magnetic material therein. As such, an increase in cross-sectional area of magnetic film winding 2208, such as by increasing the length l or the thickness t, will provide an increase in magnetic field. The volume of magnetic material within magnetic film winding 2208 may additionally be increased by increasing the ratio of magnetic material to substrate therein, as discussed above with reference to FIGS. 6-8.

Further, changing the height h of magnetic film winding 2208 changes the resonant frequency of the antenna.

Figure 24:
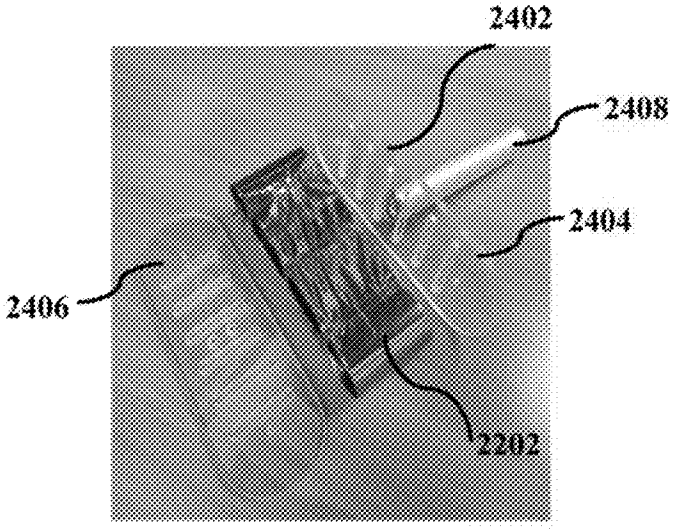
FIG. 24 illustrates a receiving blank and a core component in accordance with aspects of the present invention.

FIG. 24 illustrates a receiving blank 2402 and core component 2202 in accordance with aspects of the present invention.

As shown in the figure, receiving blank 2402 includes a guide rail 2404, a guide rail 2406 and a support post 2408. Mounting plate 2206 is arranged to be mounted between guide rail 2406 and guide rail 2408. Support post 2408 enables the mounted mounting plate 2206, guide rail 2406 and guide rail 2408 to be rotated.

Figure 25:
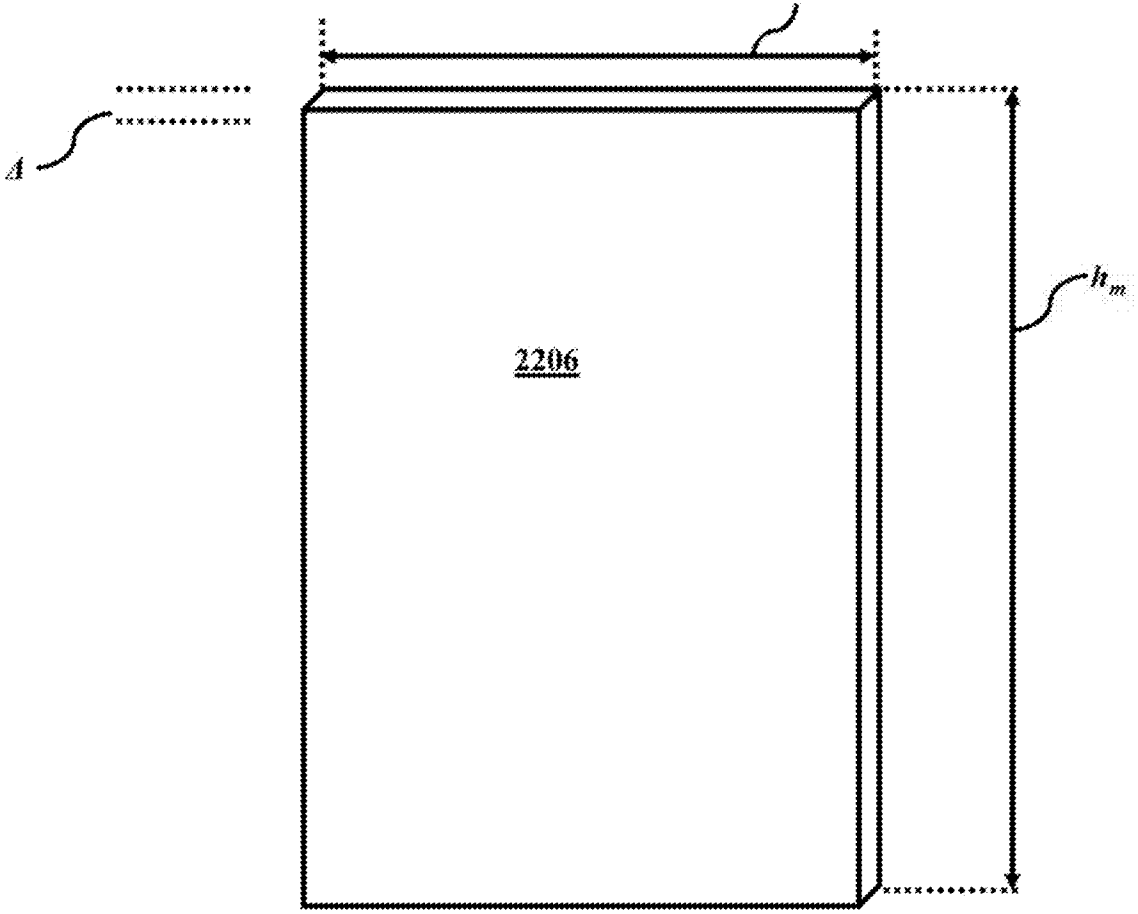
FIG. 25 illustrates an example mounting plate for a core component in accordance with aspects of the present invention.

FIG. 25 illustrates mounting plate 2206 of elongated core component 2202. As shown in the figure, mounting plate 2206 is a rectangular parallel piped having thickness Δ, a length l and a height $h_m$.

Mounting plate 2206 is used as a base support for a winding of magnetic film. This will be described with additional reference to FIGS. 26-27.

Figure 26:
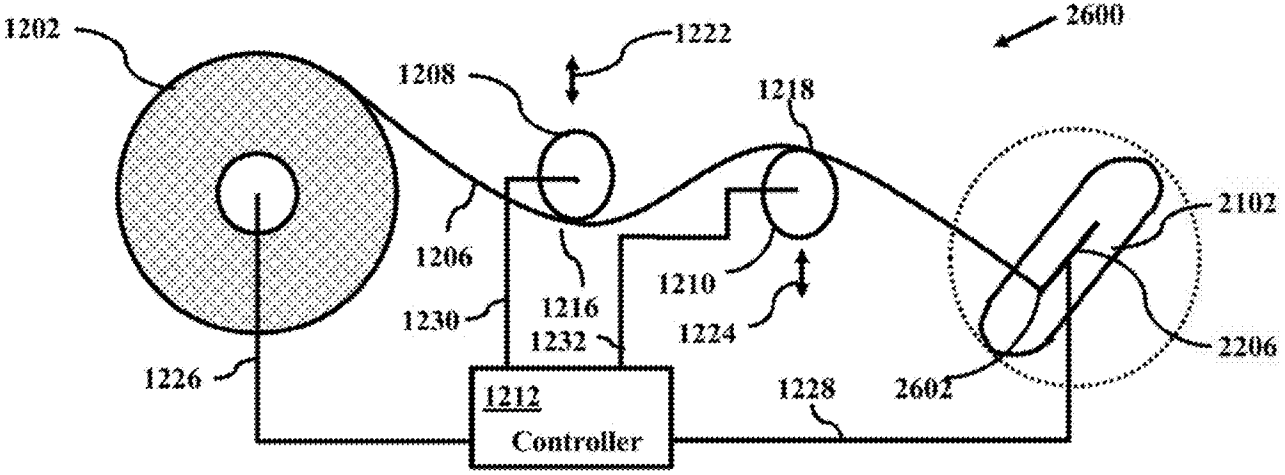
FIG. 26 illustrates an example system, at time $t_0$, for forming a core component in accordance with aspects of the present invention.

FIG. 26 illustrates an example system 2600, at time $t_0$, for forming a core component in accordance with aspects of the present invention.

System 2600 is similar to system 1200 discussed above with reference to FIG. 12, with receiving blank 1204 being exchanged with receiving blank 2402 of FIG. 24.

Tension roller 1208 can rotate and is able to move up and down in a direction indicated by double arrow 1222. Film 1206 is able to pass over rolling tension roller 1208 at location 1216. Tension roller 1210 can rotate and is able to move up and down in a direction indicated by double arrow 1224. Film 1206 is able to pass over rolling tension roller 1210 at location 1218. As such, the tension of magnetic film 1206 may be managed by moving either or both of tension roller 1208 and tension roller 1210 in a respective direction. Tension roller 1208 and tension roller 1210 are non-limiting examples of known tension management devices. Any known device for maintaining a predetermined tension may be used so as to prevent film 1206 from buckling or curling as it winds around mounting plate 2206.

Receiving blank 2402 is rotatable. Mounting plate 2206 is able to have an end of film 1206 anchored thereto at location 2602, by any known anchoring method or system, non-limiting examples of which include an adhesive, magnetically, a slit for which film 1206 may be inserted, or a grabbing mechanism.

Film 1206 is unrolled from roll 1202, is fed by tension roller 1208, is fed by tension roller 1210 and is anchored onto mounting plate 2206.

Controller 1212 is able to control the rate at which roller 1202 unrolls the film and is able to control the rate at which receiving blank 2402 winds the film. Controller 1212 is additionally able to control the amount of movement of tension roller 1208 along the direction of double arrow 1222 and to control the amount of movement of tension roller 1210 along the direction of double arrow 1224.

Figure 27:
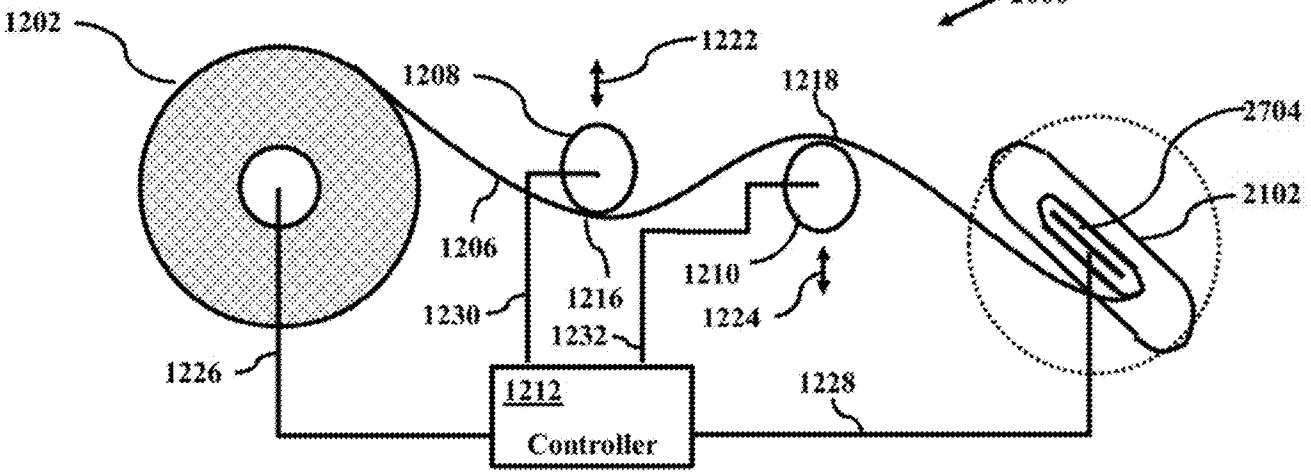
FIG. 27 illustrates the example system of FIG. 26, at a time $t_1$.

FIG. 27 illustrates example system 2600 of FIG. 26, at a time $t_1$.

As film 1206 unrolls from roll 1202, it eventually winds around mounting plate 2206 to from a magnetic loop core, an incomplete portion of which is indicated in FIG. 27 as elongated core portion 2704. Controller 1212 positions tension rollers 1208 and 1210 so as to ensure film 1206 does not crinkle, fold or bunch as it is wound about mounting plate 2206. As such, this method of creating layers of film avoids the problems associated with the stacked film core discussed above with reference to FIG. 6. Further, inter-layer adhesives are not needed to maintain circular core component by winding around mounting plate 2206. This is a beneficial aspect, as inter-layer adhesives are not desirable because they decrease the overall Q of the circular core component. Once the elongated core component is complete, e.g. the number of windings reaches a total required thickness in the elongated core component, locally arranged electromagnets (not shown) may be used to hold a film to its mandrel form. At that point, a compression form may be used to hold the wound core component on mounting plate 2206. Then binding strips 2210 and 2212 are applied to secure the wound core component prior to removal of receiving blank 2402 from the winding assembly.

The magnetic core component winding process described above with reference to FIGS. 26-27 is a non-limiting example embodiment for purposes of explanation. It should be noted that any known method may be used to form an elongated magnetic core component in accordance with aspects of the present invention.

Figure 28:
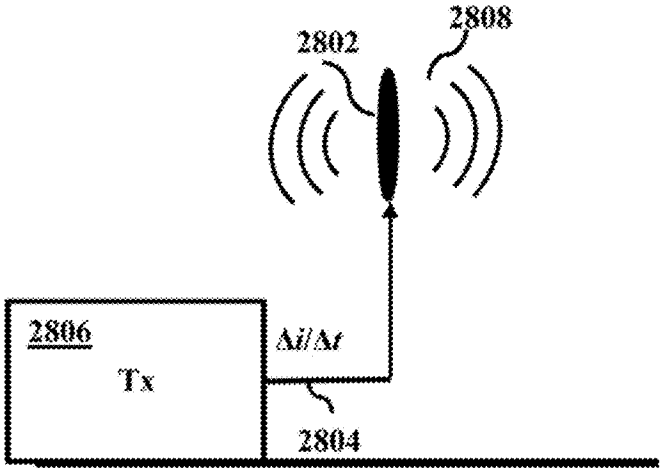
FIG. 28 illustrates a elongated MLA using a magnetic loop in accordance with aspects of the present invention to transmit a signal.

FIG. 28 illustrates an elongated MLA 2802 using a magnetic loop in accordance with aspects of the present invention to transmit a signal.

As shown in the figure, elongated MLA 2802 is disposed to receive a current 2804 from a transmitter 2806. Changes in current 2804 generate transmission signals 2808 from elongated MLA 2802.

Figure 1:
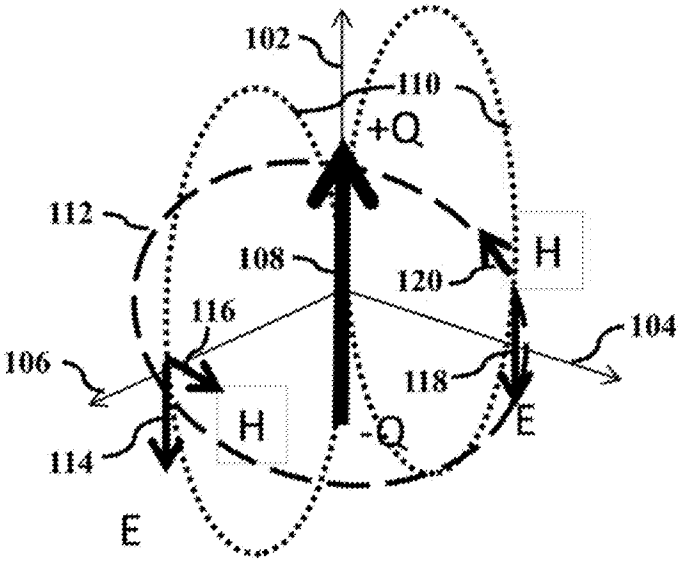
FIG. 1 illustrates an electrical dipole and the electric and magnetic fields associated therewith.
Figure 2:
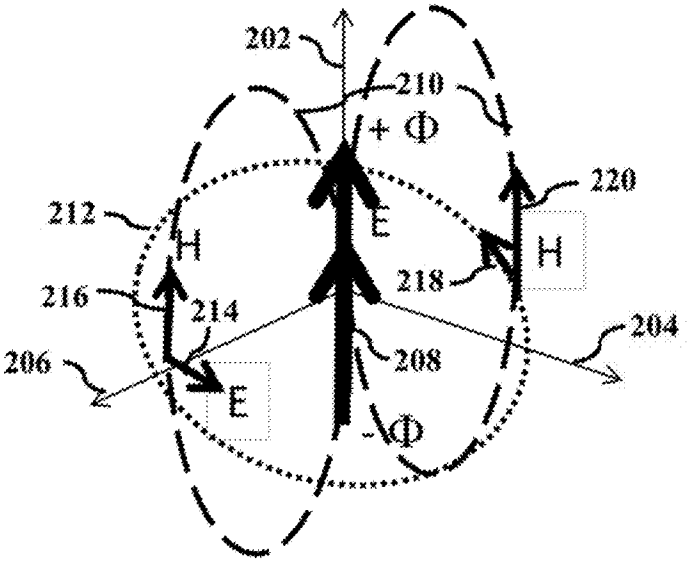
FIG. 2 illustrates a magnetic dipole and the electric and magnetic fields associated therewith.
Figure 4:
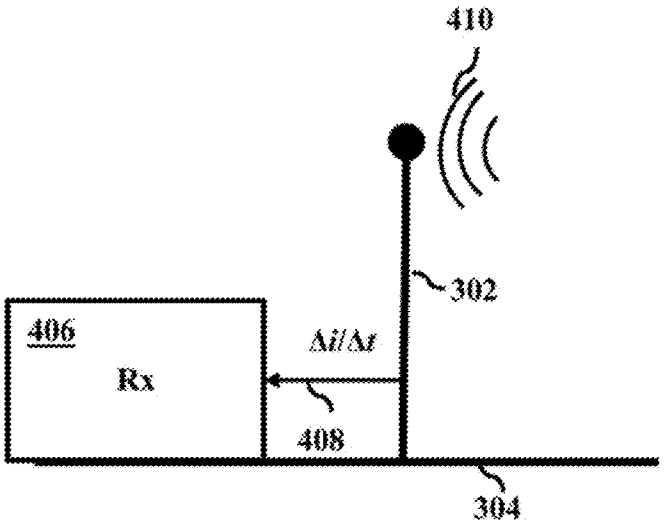
FIG. 4 illustrates the prior art electric monopole antenna, of FIG. 3, using an electrical dipole to receive a signal.
Figure 3:
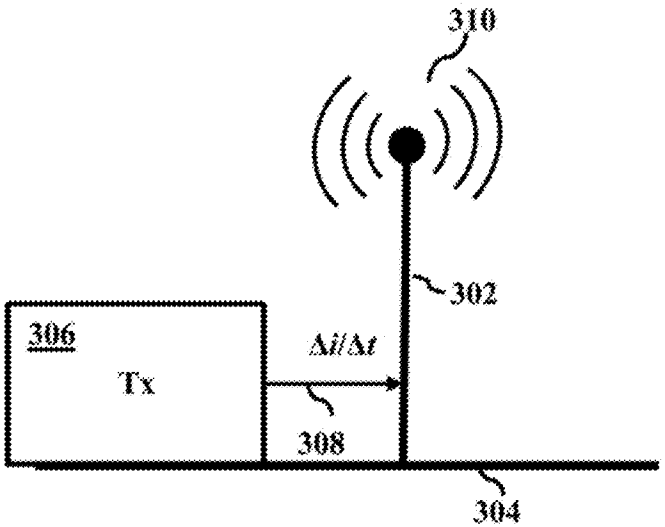
Prior Art FIG. 3
FIG. 3 illustrates a prior art electric monopole antenna using an electrical dipole to transmit a signal.
Figure 5:
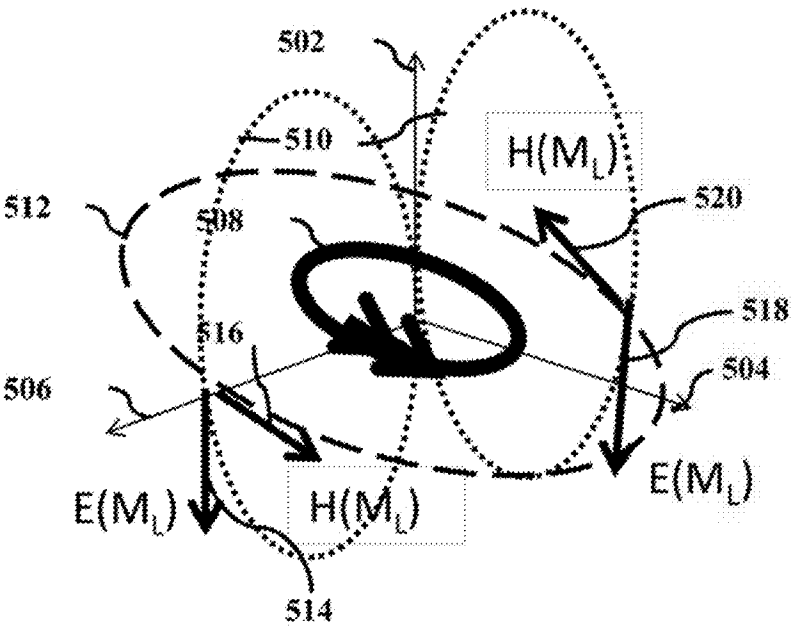
FIG. 5 illustrates a magnetic loop and the electric and magnetic fields associated therewith.

Consider the situation where current 2804 is fed to elongated MLA 2802 such that generated magnetic loop within the core component resembles the magnetic loop discussed above with reference to FIG. 5. In this manner, power will radiate outwardly from elongated MLA 2802. As the current alternates, the radiating power will similarly alternate, providing transmission signals 2808, which radiate outwardly. In this manner, elongated MLA 2802 is an active device, transmitting a signal. Elongated MLA 2802 may also perform as a passive device, receiving a signal.

Figure 29:
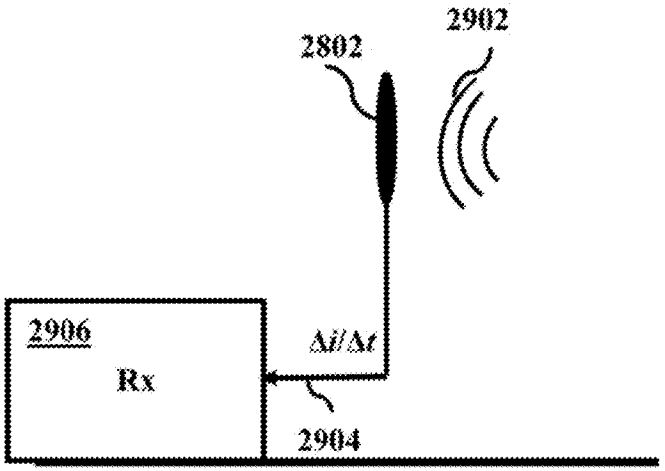
FIG. 29 illustrates the elongated MLA of FIG. 28, using a magnetic loop to receive a signal.

FIG. 29 illustrates elongated MLA 2802 of FIG. 28, using a magnetic loop to receive a signal.

As shown in the figure, elongated MLA 2802 is arranged to receive signals 2902. Changes in signals 2902 generate changes in a current 2904, which is provided to a receiver 2906.

Signals 2902 are electromagnetic waves. The interaction of signals 2902 induces magnetic fields within the magnetic material of the magnetic elongated core of elongated MLA 2802. The magnetic fields within the magnetic elongated core of elongated MLA 2802 induce a current in an electrical excitation component of elongated MLA 2802. As the electromagnetic fields change within signals 2902, the magnitude and/or polarity of the magnetic fields within the magnetic elongated core of elongated MLA 2802 similarly change. This change in the magnetic fields corresponds to current 2904. Receiver 2906 is able to receive current 2904, and changes therein, to decode signals 2902. In this manner, elongated MLA 2802 is a passive device, receiving a signal.

Figure 30:
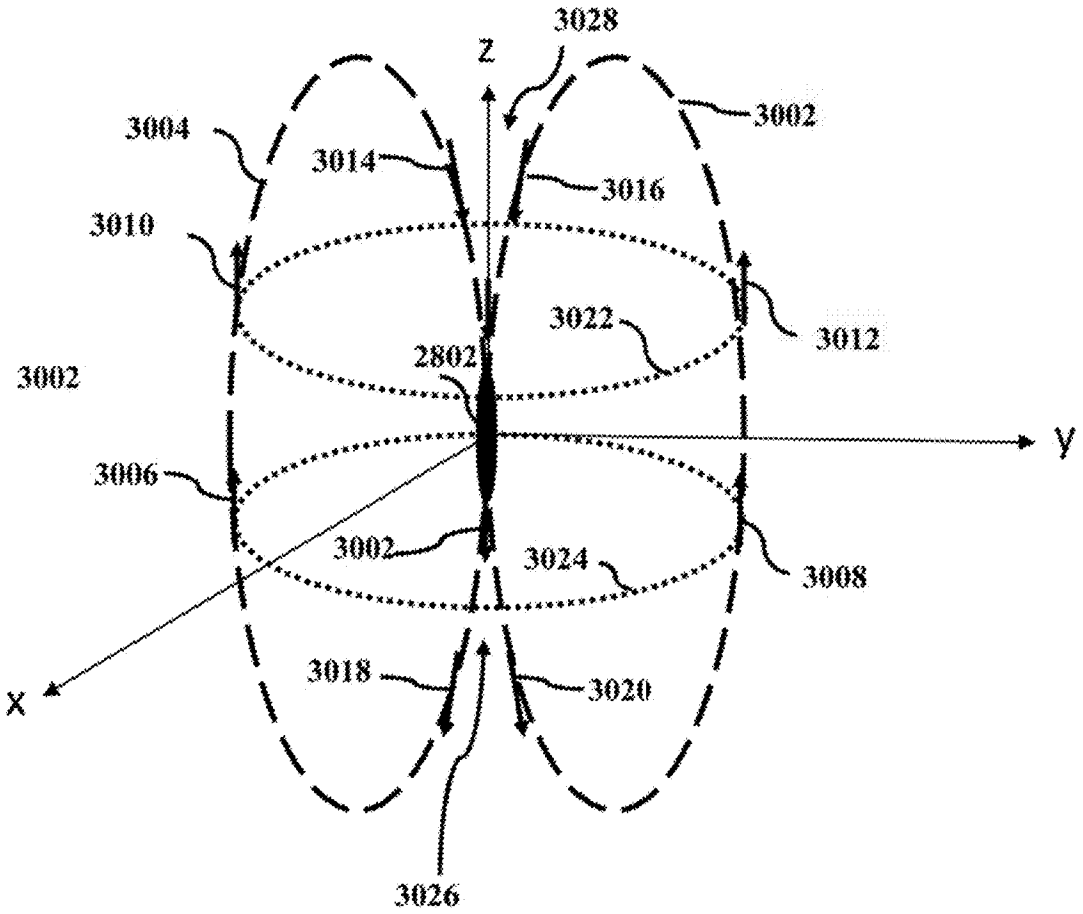
FIG. 30 illustrates an example magnetic field core antenna in accordance with aspects of the present invention.

FIG. 30 illustrates the electric field vectors of elongated MLA 2802 when transmitting at a time $t_1$.

As shown in the figure, the magnetic field vectors make a path through elongated MLA 2802 within a xyz coordinate system, a sample representation of which is indicated as dashed lines 3002 and 3004. At time $t_1$, the magnetic field vectors on the outer surface are pointing in the positive z-direction as shown by arrows 3006, 3008, 3010 and 3012. Further, the magnetic field vectors on the inner surface are pointing in the negative z-direction as shown by arrows 3014, 3016, 3018 and 3020. The electric fields radiate generally equally within the ex-plane as indicated by dotted circles 3022 and 3024.

As the magnetic field oscillates in elongated MLA 2802 the radiating electric fields (and corresponding magnetic fields—not shown) will alternate in direction. However, for purposes of discussion, FIG. 30 illustrates a "snap shot" of the fields at a single time.

As further noted in the figure, the magnetic field radiation has a null along the z-axis as shown in areas 3026 and 3028. In other words, no signal is transmitted in a direction normal to the flat surface of elongated MLA 2802. These nulls are a result of electrical excitation component 2204 (as shown in FIGS. 22A-B). The null is the summation of all radiation in the positive z direction of elongated MLA 2802. The inward pointing vectors will sum to zero (at infinity along the z axis), and thus there will be a null there. It is impossible (theoretically) to create an antenna with a uniform field everywhere. As such, there must always be at least one null in the radiation pattern of an omnidirectional antenna.

Figure 17:
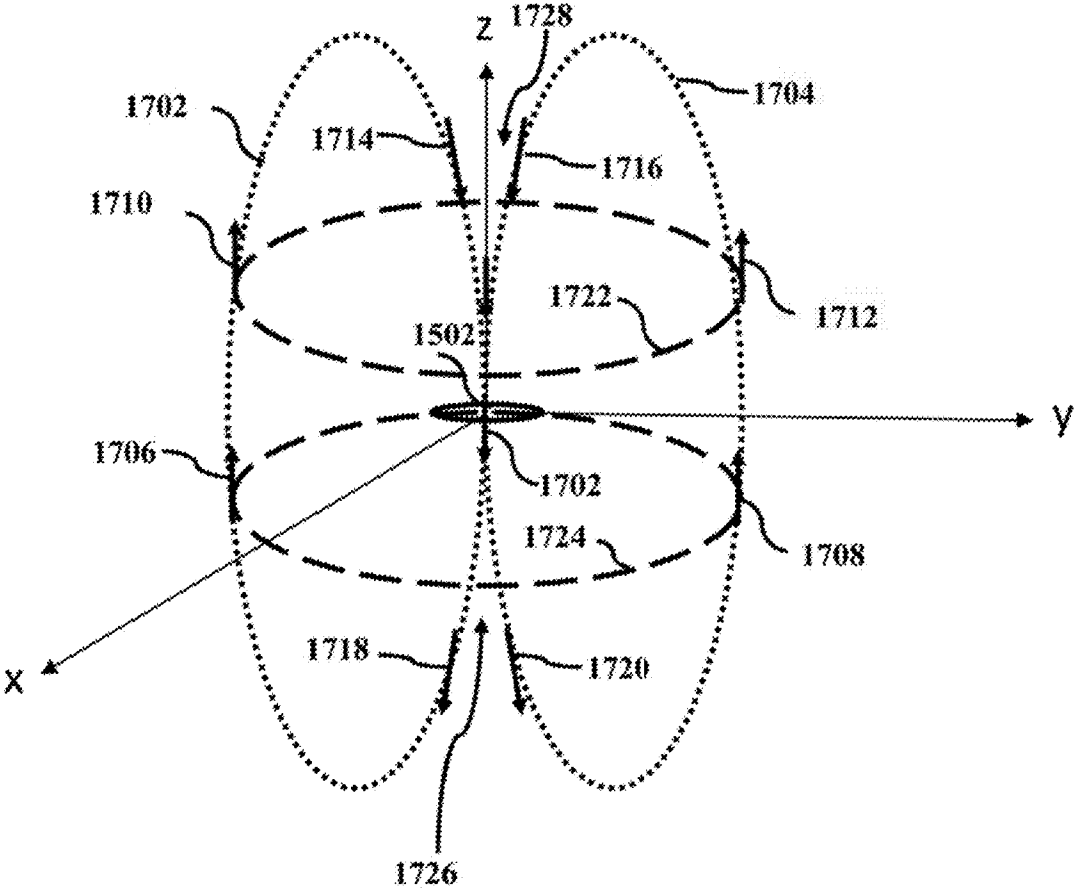
FIG. 17 illustrates a magnetic dipole created by the prior art circular MLA of FIG. 15 and the electric and magnetic fields associated therewith when transmitting at a low frequency.

Returning to FIG. 30, in a manner similar to circular MLA 1502 of FIG. 17, the broadside beam pattern of elongated MLA 2802 along the xy-plane is prominent and uniform. However, as opposed to circular MLA 1502 of FIG. 17, it has been determined through experimentation that as the transmitting wavelength approaches the resonant wavelength of elongated MLA 2802, the broadside beam pattern along the xy-plane does not have a null.

Accordingly, elongated MLA 2802 has a much broader operational wavelength over circular MLA 1502 of FIG. 17.

There is a more important benefit to an elongated MLA in accordance with aspects of the present invention over circular MLA 1502 of FIG. 17 and a conventional electric dipole. This will be described in greater detail with reference to FIG. 31.

Figure 31:
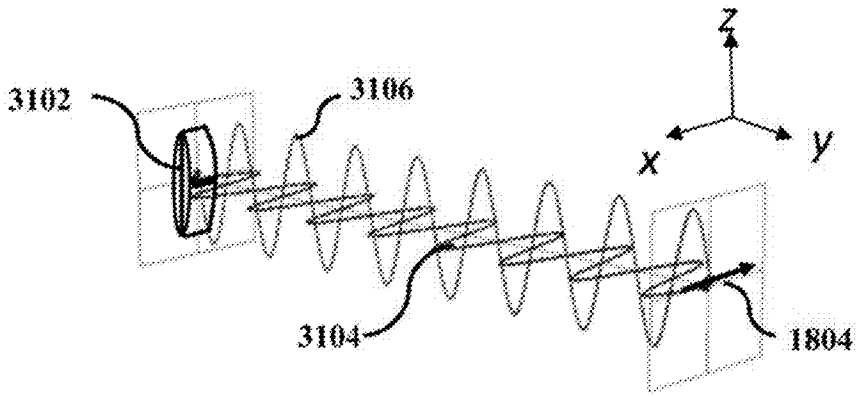
FIG. 31 illustrates an electromagnetic wave transmitting from an elongated MLA in accordance with aspects of the present invention to a conventional electric dipole antenna.

FIG. 31 illustrates an electromagnetic wave transmitting from an elongated MLA 3102 in accordance with aspects of the present invention to conventional electric dipole antenna 1804.

Figure 18:
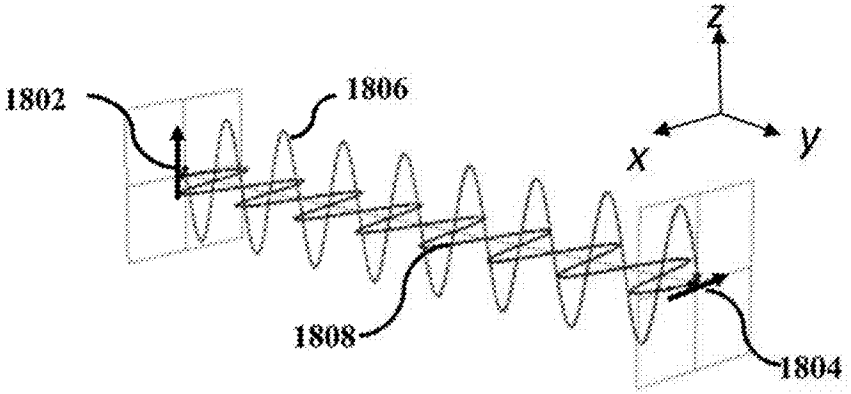
FIG. 18 illustrates an electromagnetic wave transmitting from a conventional electric dipole antenna to a conventional electric dipole antenna.
Figure 19:
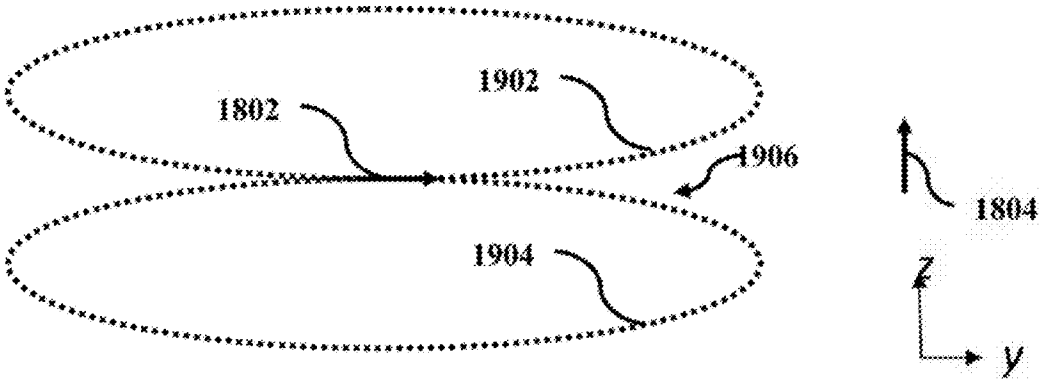
FIG. 19 illustrates electric field lines from a conventional transmitting electric dipole antenna disposed perpendicularly to a receiving electric dipole antenna.
Figure 20:
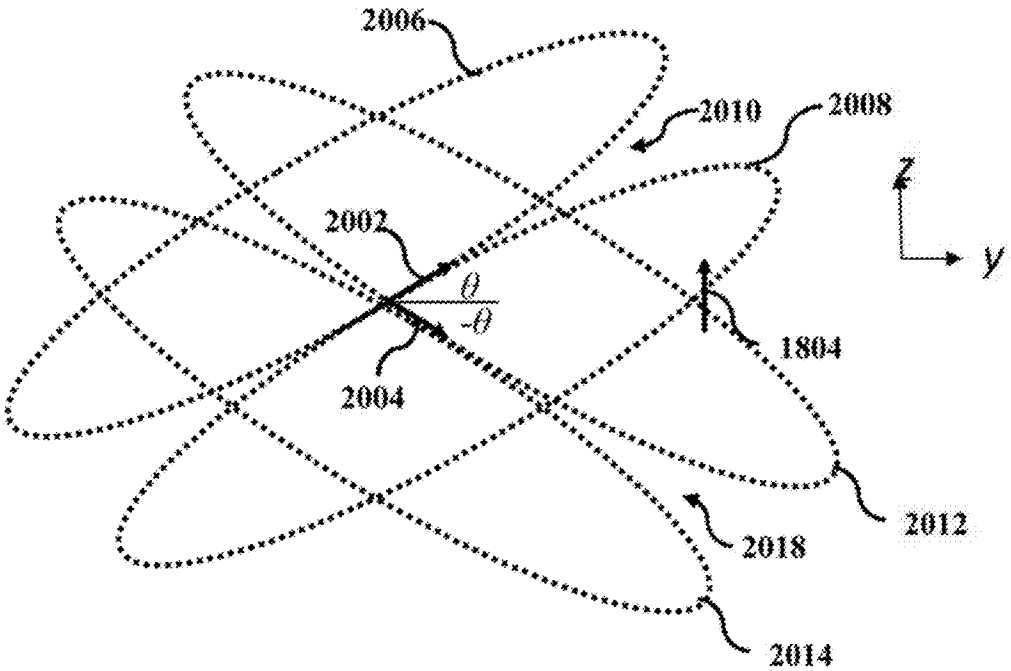
FIG. 20 illustrates electric field lines from two conventional transmitting electric dipole antennas disposed at an angle relative to a receiving electric dipole antenna.
Figure 21:
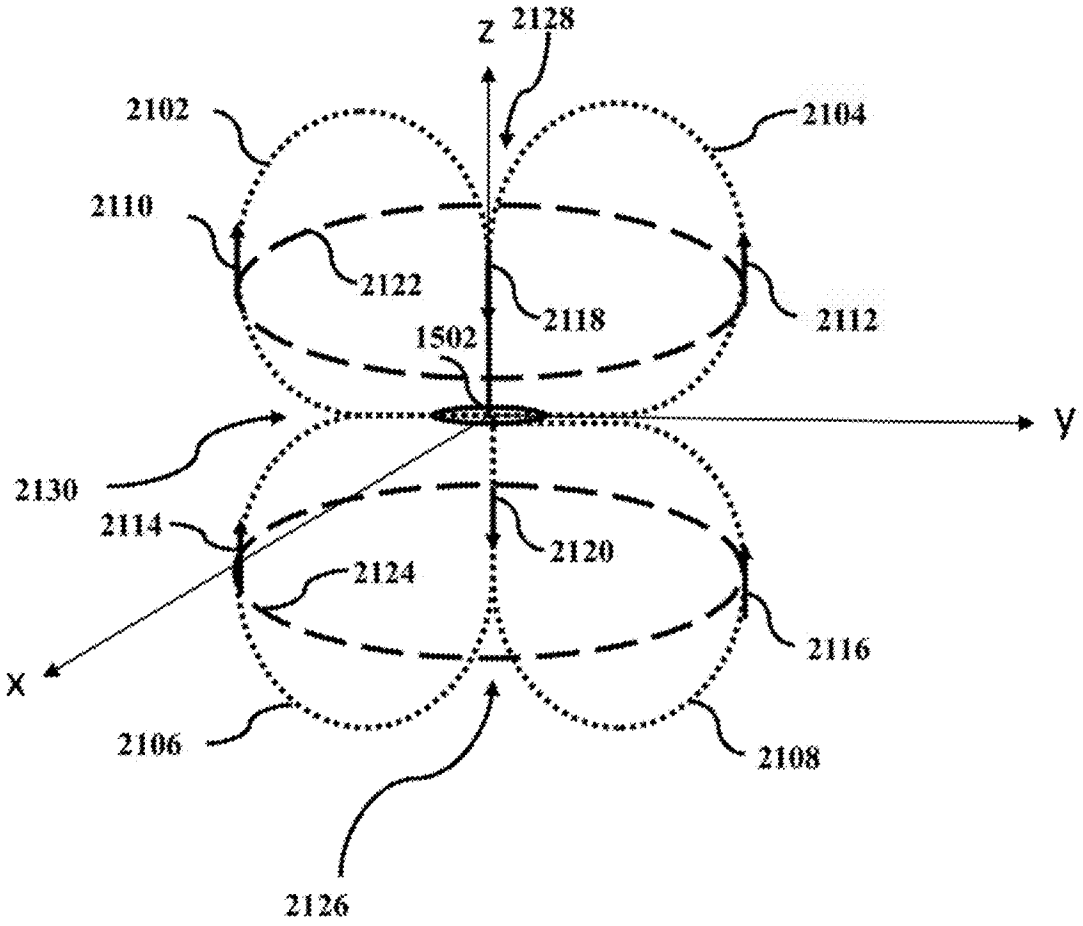
FIG. 21 illustrates a magnetic dipole created by the prior art circular MLA of FIG. 15 and the electric and magnetic fields associated therewith when transmitting at a high frequency.

As shown in the figure, elongated MLA 3102 is disposed so as to be rotated 90° from conventional receiving electric dipole antenna 1804. This arrangement between the two antennas may occur for example in a situation where a vehicle may not be able to have an antenna disposed in the z direction in order to meet prescribed aerodynamic design parameters. In such a situation, a transmission from elongated MLA 3102 to conventional receiving electric dipole antenna 1804 includes a sinusoidal electric field 3104 and a sinusoidal magnetic field 3106, wherein electric field 3104 is perpendicular to magnetic field 3106. In particular, electric field 3104 oscillates in the xy-plane, along the disposition (length) of receiving electric dipole antenna 1804. Electric field 3104 is directly perpendicular to electric field 1806 of conventional transmitting electric dipole antenna 1802 discussed above with reference to FIG. 18.

On the contrary, magnetic field 3106 oscillates in the xy-plane, perpendicular the disposition (length) of receiving electric dipole antenna 1804. Magnetic field 3106 is directly perpendicular to magnetic field 1808 of conventional transmitting electric dipole antenna 1802 discussed above with reference to FIG. 18.

In this manner, it is electric field 3104 that most greatly affects the operation of receiving electric dipole antenna 1804, not magnetic field 3106. This is opposite to the situation discussed above with reference to FIG. 18, wherein magnetic field 1808 most greatly affects the operation of receiving electric dipole antenna 1804.

As such, a elongated MLA in accordance with aspects of the present invention provides the previously-elusive, yet highly-sought-after omnidirectional e-field with a horizontal polarization (the yz-plane).

A further benefit of the wound magnetic core component in accordance with aspects of the present invention is an amplification of the magnetic field. This magnetic field amplification improves the efficiency of an antenna using such a wound magnetic core component. This will be described with reference to FIG. 32.

Figure 32:
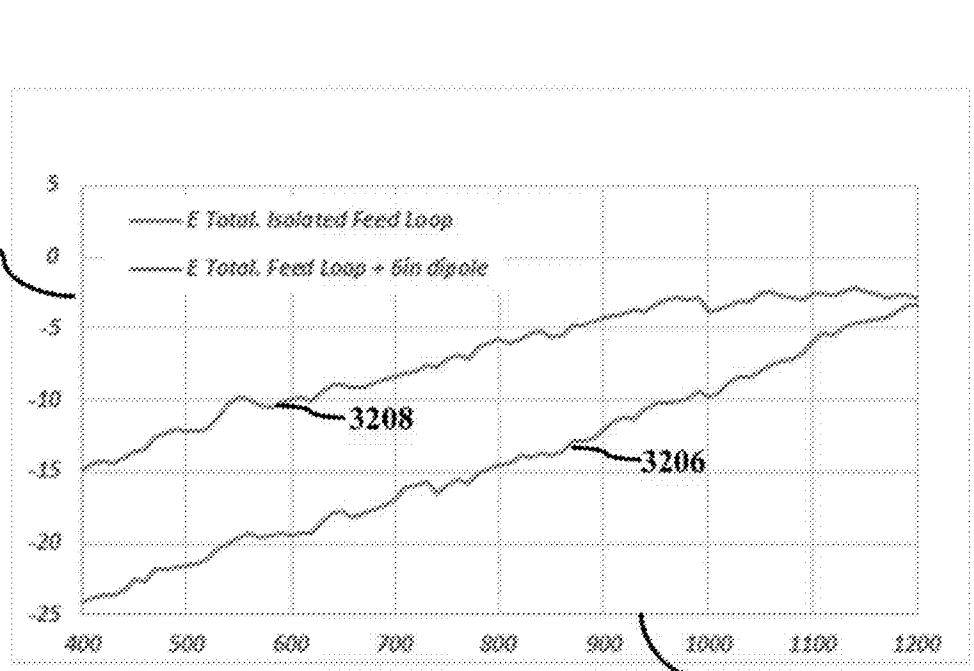
FIG. 32 shows a graph of maximum gain of a conventional feed loop antenna and a magnetic feed loop antenna in accordance with aspects of the present invention.

FIG. 32 shows a graph 3200 of maximum gain of a conventional feed loop antenna and a magnetic feed loop antenna when transmitting in accordance with aspects of the present invention.

As shown in the figure, graph 3200 includes a y-axis 3202 measuring gain in decibels, an x-axis 3204 measuring frequency in MHz, a function 3206 and a function 3208. Function 3206 corresponds to the gain as a function of frequency for a feed loop similar to electrical excitation component 2204 discussed above with reference to FIGS. 22 A-C. Function 3206 corresponds to the gain as a function of frequency for a feed loop and elongated core component similar to electrical excitation component 2204 elongated core component 2202 discussed above with reference to FIGS. 22 A-C.

It is clear from FIG. 32 that the addition of the elongated core component provides a 10 dB gain over a substantial portion of the spectrum.

Figure 33:
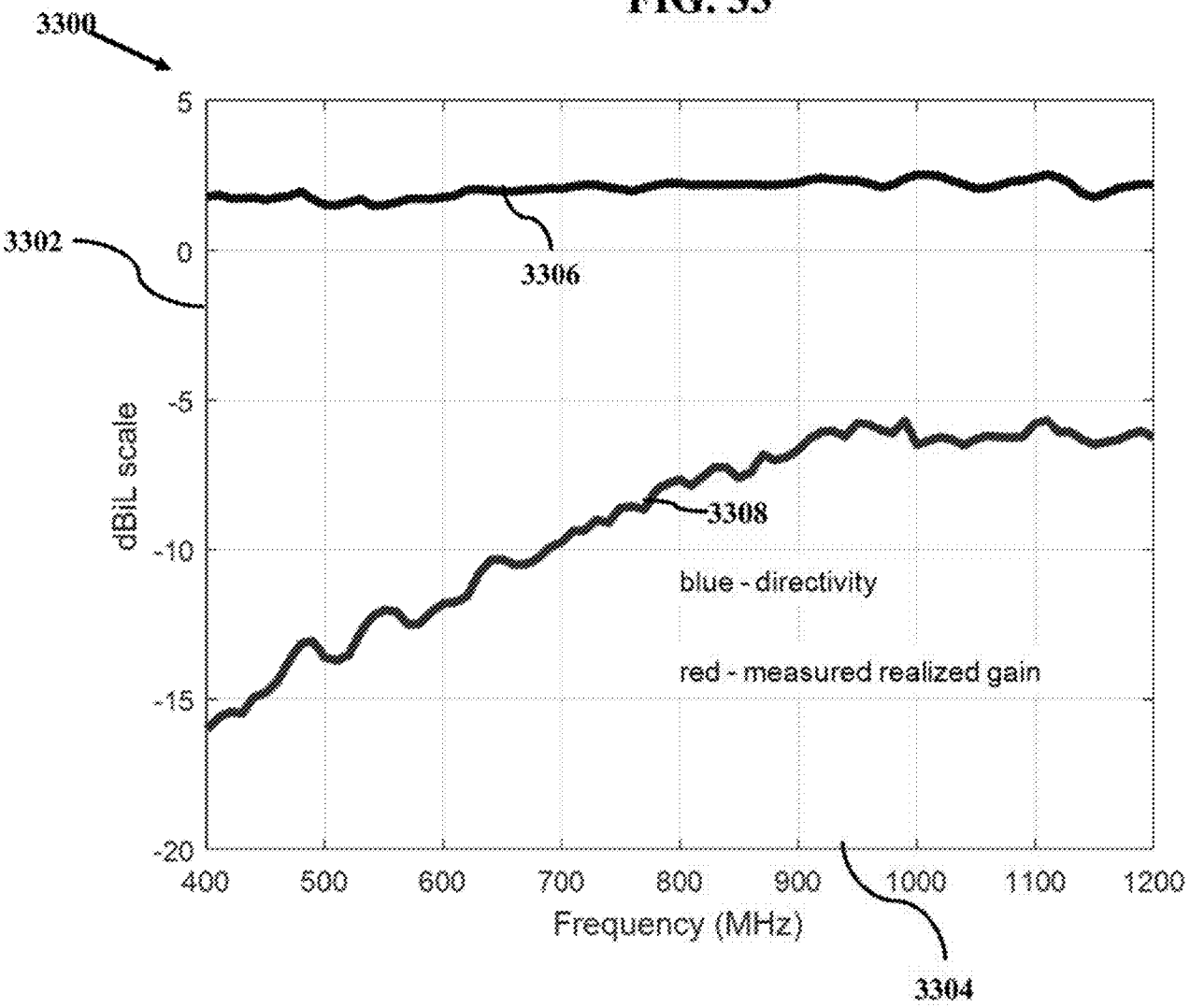
FIG. 33 illustrates a graph of realized gain and directivity of a magnetic feed loop antenna in accordance with aspects of the present invention.

FIG. 33 illustrates a graph 3300 of realized gain and directivity with a horizontal polarization of a magnetic feed loop antenna in accordance with aspects of the present invention.

As shown in the figure, graph 3300 includes a y-axis 3302 measuring a decibels of power (dBiL), linearly polarized, with respect to a theoretical perfect isotropic radiator, an x-axis 3304 measuring frequency in MHz, a function 3306 and a function 3308. Function 3306 corresponds to the directivity as a function of frequency for a feed loop and elongated core component similar to electrical excitation component 2204 and elongated core component 2202 discussed above with reference to FIGS. 22 A-C. Function 3308 corresponds to the gain as a function of frequency for a feed loop and elongated core component similar to electrical excitation component 2204 and elongated core component 2202 discussed above with reference to FIGS. 22 A-C.

Figure 34:
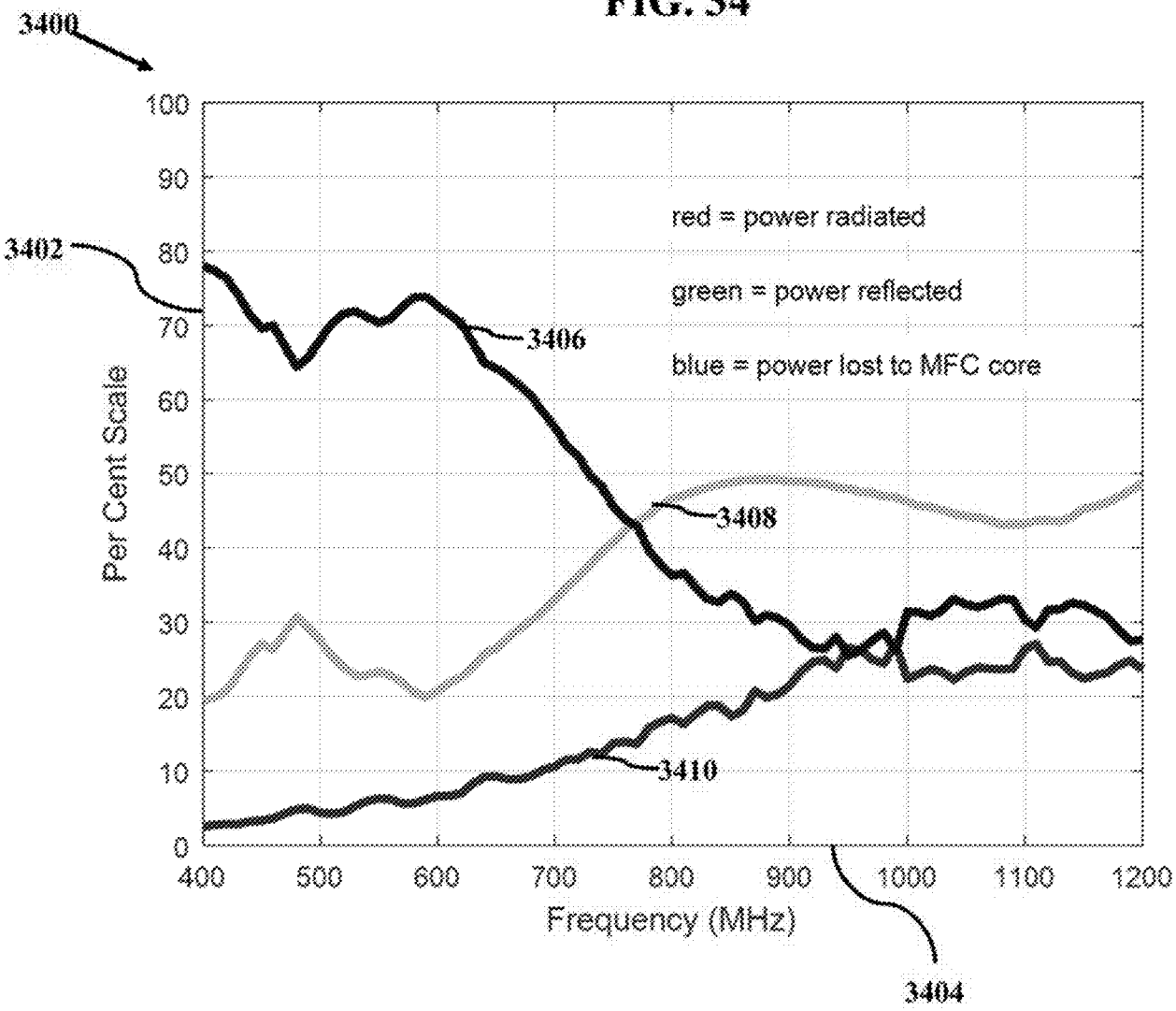
FIG. 34 illustrates a graph of a total power budget of a magnetic feed loop antenna in accordance with aspects of the present invention.

FIG. 34 illustrates a graph 3400 of a total power budget of a magnetic feed loop antenna in accordance with aspects of the present invention.

As shown in the figure, graph 3400 includes a y-axis 3402 measuring a percent scale, an x-axis 3404 measuring frequency in MHz, a function 3406, a function 3408 and a function 3410. Function 3406 corresponds to the power lost in an elongated core component similar to core component 2202 discussed above with reference to FIG. 22. Function 3408 corresponds to the power reflected at the feed point. Function 3410 corresponds to the power radiated from the magnetic feed loop antenna, similar to elongated MLA 2802 discussed above with reference to FIG. 28.

Figure 35:
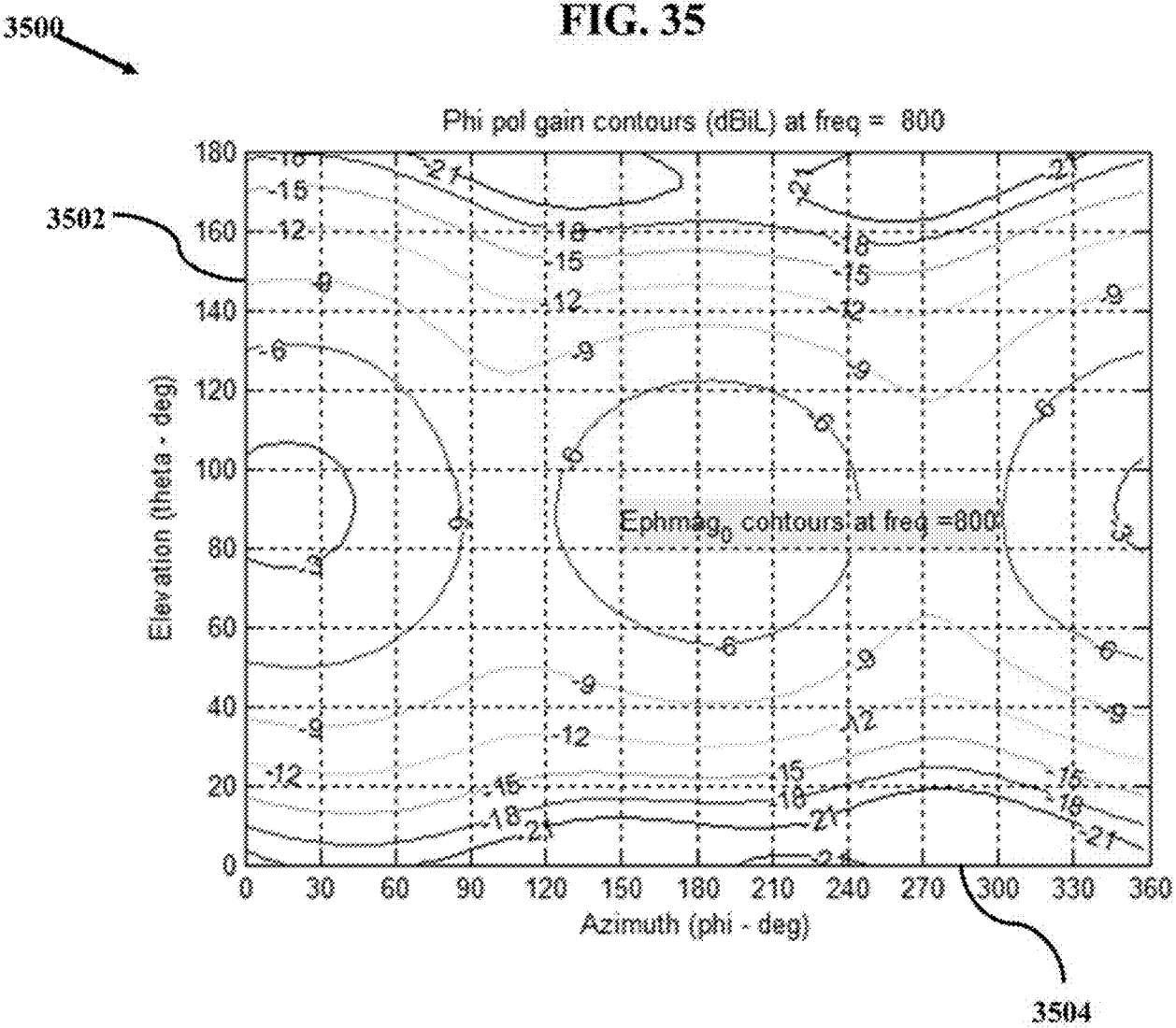
FIG. 35 illustrates a realized gain contour plot at 800 MHz of a magnetic feed loop antenna in accordance with aspects of the present invention.

FIG. 35 illustrates a realized gain contour plot 3500 at 800 MHz of an elongated MLA in accordance with aspects of the present invention.

As shown in the figure, plot 3500 includes a y-axis 3502 measuring an elevation angle in degrees and an x-axis 3504 measuring an azimuth angle in degrees.

For perspective, returning to FIG. 30, the positive z-axis corresponds to 0° on y-axis 3502 of plot 3500 of FIG. 35, whereas the negative z-axis corresponds to 180° on y-axis 3502 of plot 3500 of FIG. 35. Further, the xy plane of FIG. 30 corresponds to x-axis 3504 of plot 3500 of FIG. 35.

As such, from plot 3500 it is clear that the realized gain at 800 MHz is greatest at 90° elevation. However, this gain is not constant throughout the 360° surrounding the elongated MLA. It is clear from plot 3500, that the elongate MLA in accordance with aspects of the present invention provides a peak gain better than −3 dB gain at horizon (Elevation=90 degrees) with a runout of less than 6 dB. As such, plot 3500 provides evidence that: A) the peak gain is at the horizon; B) the horizon is well-filled with gain without large nulls; and C) there is a smooth roll off at higher and lower angles, and thus it is performing as an omnidirectional antenna.

Figure 36:
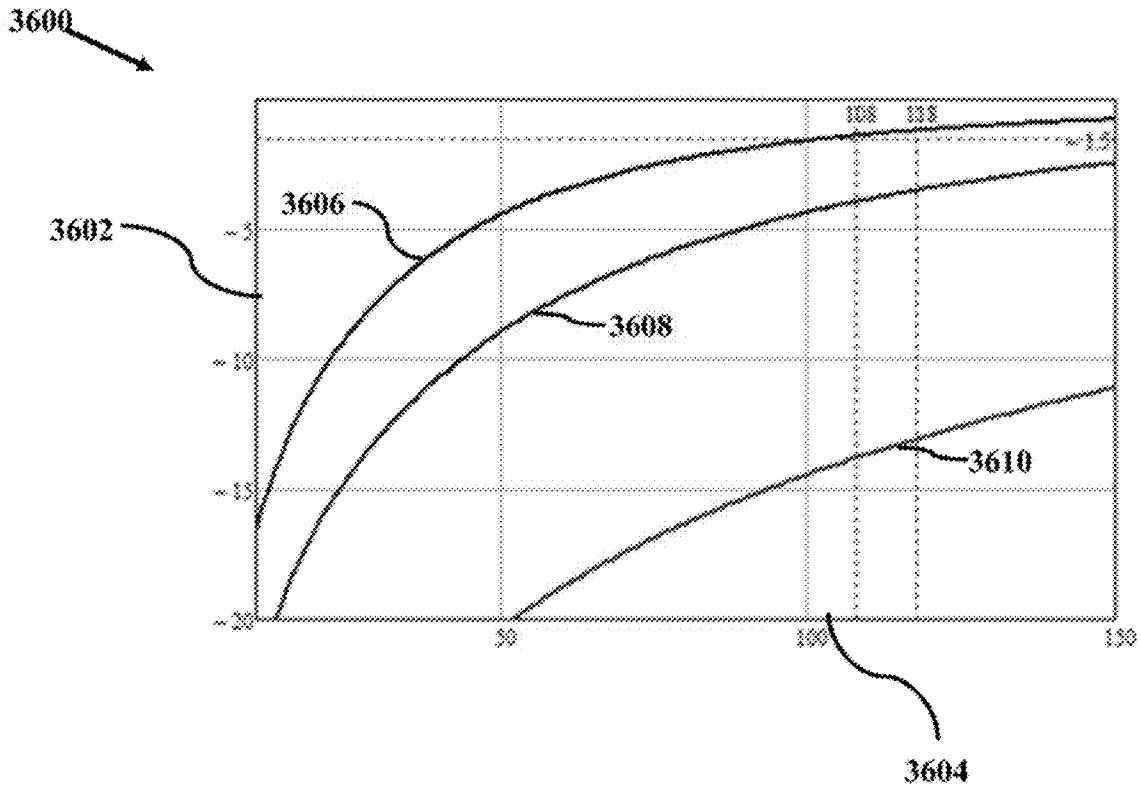
FIG. 36 illustrates a graph of calculated radiation efficiency vs frequency.

FIG. 36 illustrates a graph 3600 of calculated radiation efficiency vs frequency.

As shown in the figure, graph 3600 includes a y-axis 3602 measuring an efficiency in dB, an x-axis 3604 measuring frequency in MHz, a function 3606, a function 3608 and a function 3610. Function 3606 corresponds to the efficiency as a function of frequency of an elongated MLA, which has a height h of 1 meter and a thickness t of 2 inches, in accordance with aspects of the present invention. Function 3608 corresponds to the efficiency as a function of frequency of an elongated MLA, which has a height h of 1 meter and a thickness t of 1 inch, in accordance with aspects of the present invention. Function 3610 corresponds to the efficiency as a function of frequency of a prior art ferrite dipole antenna, which has a height h of 1 meter and a thickness t of 1 inch.

As shown in the figure, both elongated MLAs provide a much improved efficiency as a function of frequency as compared to the prior art dipole antenna. Further, by comparing function 3606 to function 3608, it is clear that the increased thickness provides an improved efficiency as a function of frequency. It should be noted that the improved efficiency illustrates the value of increased cross-sectional area of the magnetic film winding of the elongated MLA.

Figure 37:
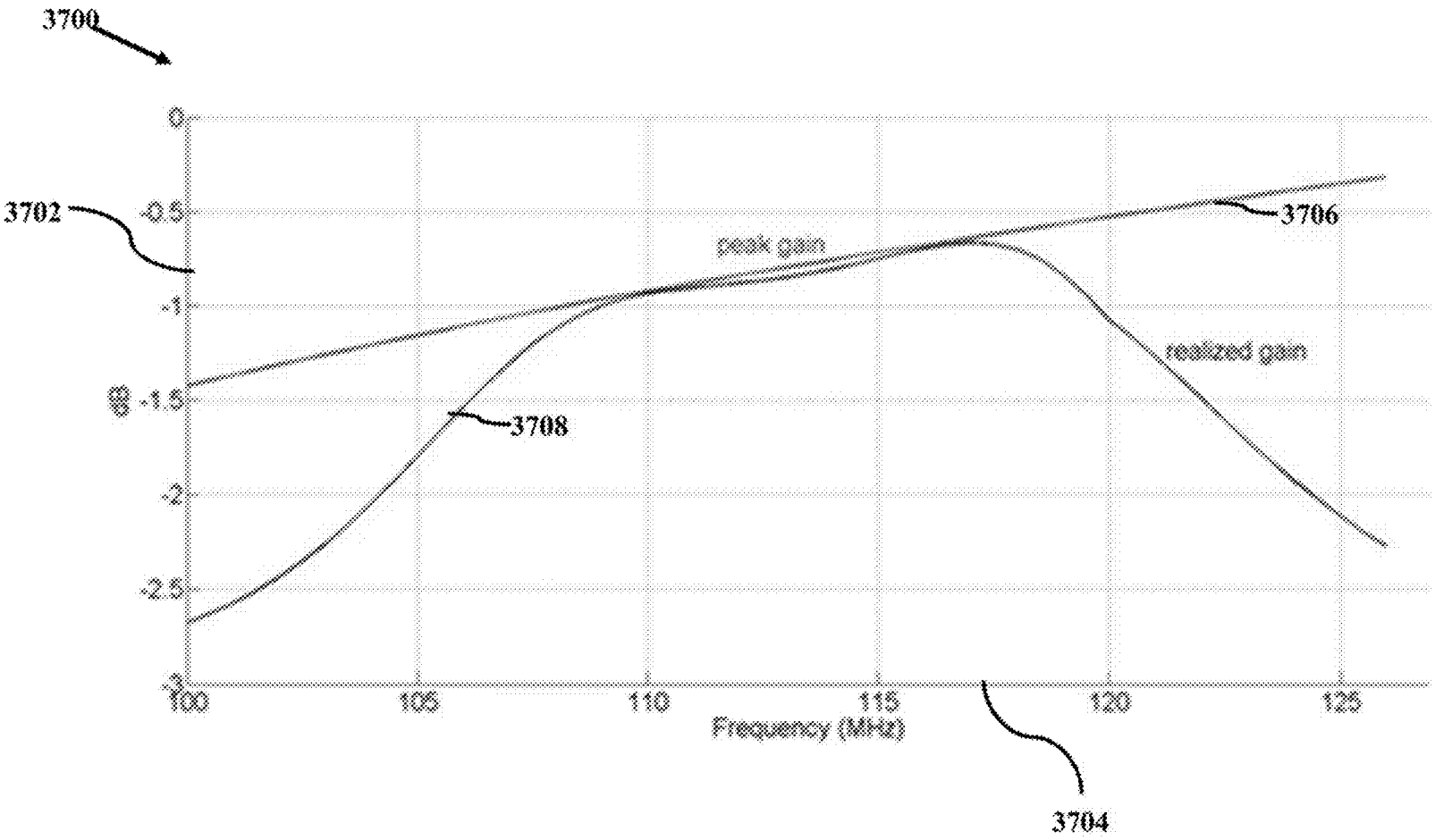
FIG. 37 illustrates a graph of realized gain a magnetic feed loop antenna in accordance with aspects of the present invention.

FIG. 37 illustrates a graph 3700 of realized gain an elongated MLA in accordance with aspects of the present invention.

As shown in the figure, graph 3700 includes a y-axis 3702 measuring gain in dB, an x-axis 3704 measuring frequency in MHz, a function 3706 and a function 3708. Function 3706 corresponds to peak gain. Peak gain is the theoretical limit achievable only if the antenna is perfectly matched. Realized gain is measured gain. The difference between function 3706 and function 3708 is the loss of the antenna, which is the sum of two losses —interior (resistive) losses, and reflected power at the input port (poorly matched). With a better matching or an improved feed, one can push the performance (realized gain) closer to the theoretical peak gain. Function 3708 corresponds to the realized gain as a function of frequency of an elongated MLA in accordance with aspects of the present invention.

It can be noted from the figure that approximately 110-118 MHz is a fairly small fractional bandwidth, but is has an application to aviation landing instruments. What is noticed is that the antenna is matched very well in this range.

An elongated MLA in accordance with aspects of the present invention may be used in place of an electric dipole antenna. One specific use include with a VHF Omnidirectional Radio (VOR), which is a type of short-range radio navigation system for aircraft.

The conventional electric dipole antenna and the circular MLA magnetic dipole antenna provide an omnidirectional magnetic field in a horizontal polarization. What has been highly sought after is an antenna that can transmit an omnidirectional electric field in a horizontal polarization. Systems using a combination of offset conventional electric dipole antennas have been used to approximate an omnidirectional electric field in a horizontal polarization. However such systems are inefficient.

An elongated MLA in accordance with aspects of the present invention provides a true omnidirectional electric field in a horizontal polarization.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The exemplary embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. An antenna comprising:

an electrical excitation component having an input and a conducting component, said conducting component being operable to conduct oscillating current from said input; and a core component comprising a wound magnetic film having a substrate and a magnetic material layer, said core component being operable to have a magnetic current loop induced therein, wherein said electrical excitation component is arranged such that concentric oscillating magnetic fields associated with oscillating current conducted through said electrical excitation component are additionally associated with an oscillating magnetic current loop within said core component, and wherein the oscillating magnetic current loop generates an omnidirectional horizontal electric field.

2. The antenna of claim 1, wherein said core component further comprises a rectangular mounting plate, wherein said substrate has a substrate thickness, wherein said magnetic material layer has a magnetic material layer thickness, and wherein the magnetic material layer thickness is larger than the substrate thickness.

3. The antenna of claim 1, wherein said magnetic film has a magnetic film thickness, a magnetic film width and a magnetic film length, wherein the magnetic film thickness is less than the magnetic film width, and wherein the magnetic film width is less than the magnetic film length.

4. The antenna of claim 3, wherein said magnetic material layer comprises an anisotropic magnetic material having an easy axis and a hard axis, and wherein the hard axis is parallel with the magnetic film length.

5. The antenna of claim 1, wherein said magnetic material layer comprises one of the group consisting of NiZn ferrite, $Co_2Z$ hexaferrite, CoFeSiMoB ferromagnetic metal alloy, CoZrNb ferromagnetic metal alloy, and combinations thereof.

6. A method comprising:

providing an antenna comprising:

an electrical excitation component having an input and a conducting component, said conducting component being operable to conduct oscillating current from said input; and a core component comprising a wound magnetic film having a substrate and a magnetic material layer, said core component being operable to have a magnetic current loop induced therein, wherein said electrical excitation component is arranged such that concentric oscillating magnetic fields associated with oscillating current conducted through said electrical excitation component are additionally associated with an oscillating magnetic current loop within said core component, and wherein the oscillating magnetic current loop generates an omnidirectional horizontal electric field; and providing an oscillating driving current to the input so as to transmit an RF signal having an omnidirectional horizontal electric field.

* * * * *